US009759091B2

(12) United States Patent
Ishiguro et al.

(10) Patent No.: US 9,759,091 B2
(45) Date of Patent: Sep. 12, 2017

(54) METHOD AND DEVICE FOR COOLING STEAM TURBINE GENERATING FACILITY

(71) Applicant: MITSUBISHI HITACHI POWER SYSTEMS, LTD., Kanagawa (JP)

(72) Inventors: Junichi Ishiguro, Kanagawa (JP); Tatsuaki Fujikawa, Kanagawa (JP); Yoshinori Tanaka, Kanagawa (JP); Naoto Tochitani, Kanagawa (JP); Shin Nishimoto, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 192 days.

(21) Appl. No.: 14/715,933

(22) Filed: May 19, 2015

(65) Prior Publication Data

US 2015/0260055 A1 Sep. 17, 2015

Related U.S. Application Data

(62) Division of application No. 13/201,516, filed as application No. PCT/JP2009/067851 on Oct. 15, 2009, now Pat. No. 9,074,480.

(30) Foreign Application Priority Data

Feb. 25, 2009 (JP) ..... 2009-043231

(51) Int. Cl.
*F01B 31/08* (2006.01)
*F01K 19/04* (2006.01)
(Continued)

(52) U.S. Cl.
CPC ..... *F01D 25/12* (2013.01); *F01D 5/082* (2013.01); *F01D 25/24* (2013.01); *F01K 7/04* (2013.01);
(Continued)

(58) Field of Classification Search
CPC ..... F01D 25/24; F01K 7/22; F01K 13/025
(Continued)

(56) References Cited

U.S. PATENT DOCUMENTS 2,451,261 A * 10/1948 Warren ..... F01K 3/265 277/412
5,761,896 A 6/1998 Dowdy et al.
(Continued)

FOREIGN PATENT DOCUMENTS

DE 34 06 071 8/1984
JP 58-81301 6/1983
(Continued)

OTHER PUBLICATIONS

Office Action issued May 9, 2013 in U.S. Appl. No. 13/201,516.
(Continued)

*Primary Examiner* — Deming Wan
(74) *Attorney, Agent, or Firm* — Wenderoth, Lind & Ponack, L.L.P.

(57) ABSTRACT

A steam turbine of an opposed-current single-casing type has a high pressure turbine part and an intermediate-pressure turbine part housed in a single casing. A dummy ring partitions the high-pressure turbine part and the intermediate-pressure part, and a cooling steam supply path and a cooling steam discharge path are formed in the dummy ring in the radial direction. Extraction steam or discharge steam of the high-pressure turbine part, whose temperature is not less than that of the steam having passed through a first-stage stator blade, is supplied to the cooling steam supply path. The cooling steam is fed throughout the clearance to improve the cooling effect of the dummy ring and a turbine rotor. The cooling steam is then discharged through a cooling steam discharge path to a discharge steam pipe which supplies the steam to a subsequent steam turbine.

7 Claims, 12 Drawing Sheets

(51) Int. Cl.

| | |
|---|---|
| ***F02C 7/12*** | (2006.01) |
| ***F01D 25/12*** | (2006.01) |
| ***F01D 5/08*** | (2006.01) |
| ***F01D 25/24*** | (2006.01) |
| ***F01K 7/04*** | (2006.01) |
| ***F01K 7/22*** | (2006.01) |
| ***F01K 13/00*** | (2006.01) |

(52) U.S. Cl.
CPC ..... *F01K 7/22* (2013.01); *F01K 13/006* (2013.01); *F05D 2220/31* (2013.01); *F05D 2230/00* (2013.01); *F05D 2260/201* (2013.01); *F05D 2260/2322* (2013.01)

(58) Field of Classification Search
USPC ..... 60/646, 650, 657, 658, 806, 912, 39.182
See application file for complete search history.

(56) References Cited

U.S. PATENT DOCUMENTS

| | | | | |
|---|---|---|---|---|
| 6,161,385 | A | 12/2000 | Rebhan et al. | |
| 6,412,270 | B1 | 7/2002 | Mortzheim et al. | |
| 7,003,956 | B2 * | 2/2006 | Yamashita | F01K 13/006 415/115 |
| 2008/0010968 | A1 | 1/2008 | Hartmann et al. | |
| 2008/0166222 | A1 | 7/2008 | Yamashita et al. | |
| 2008/0250790 | A1 | 10/2008 | Imano | |
| 2009/0025389 | A1 | 1/2009 | Hernandez et al. | |

FOREIGN PATENT DOCUMENTS

| | | |
|---|---|---|
| JP | 58-187501 | 11/1983 |
| JP | 61-138804 | 5/1986 |
| JP | 1-113101 | 7/1989 |
| JP | 7-145706 | 6/1995 |
| JP | 7-247806 | 9/1995 |
| JP | 9-125909 | 5/1997 |
| JP | 11-141302 | 5/1999 |
| JP | 3095745 | 8/2000 |
| JP | 2000-274208 | 10/2000 |
| JP | 2006-046088 | 2/2006 |
| JP | 2008-151013 | 7/2008 |

OTHER PUBLICATIONS

Office Action issued Dec. 6, 2013 in U.S. Appl. No. 13/201,516.
Advisory Action issued Apr. 10, 2014 in U.S. Appl. No. 13/201,516.
Office Action issued Aug. 27, 2014 in U.S. Appl. No. 13/201,516.
Notice of Allowance issued Mar. 13, 2015 in U.S. Appl. No. 13/201,516.
Corrected Notice of Allowance issued May 28, 2015 in U.S. Appl. No. 13/201,516.
Notice of Allowance issued Jul. 23, 2013 in corresponding Korean Patent Application No. KR2011-7016974 (with English Translation).
Notice of Allowance issued May 7, 2013 in corresponding Japanese Application No. 2011-501456.
International Preliminary Report on Patentability and Written Opinion of the International Searching Authority issued Aug. 30, 2011 in International (PCT) Application No. PCT/JP2009/067851 (with English translation).
International Search Report issued Jan. 19, 2010 in International (PCT) Application No. PCT/JP2009/067851.
Notice of Allowance issued Apr. 21, 2015 in corresponding Chinese Application No. 200980157134.1 (with English translation).
Extended European Search Report issued May 4, 2015 in corresponding European Application No. 09840830.5.
Extended European Search Report dated Jul. 13, 2016 issued in corresponding European Patent Application No. 16152599.3.
Japanese Decision to Grant Patent dated May 7, 2014 issued in corresponding Japanese Application No. 2013-120172.
Notice of Allowance issued Nov. 4, 2016 in corresponding European Application No. 09840830.5.

* cited by examiner

Related Art

Related Art

METHOD AND DEVICE FOR COOLING STEAM TURBINE GENERATING FACILITY

BACKGROUND OF THE INVENTION

Technical Field

The present invention relates to a method and a device for cooling a steam turbine generating facility, which improves cooling effect of a dummy seal and a rotor shaft disposed inside of the dummy seal. The steam turbine generating facility is equipped with an opposed-flow single casing steam turbine in which a plurality of turbine parts are isolated from one another by a dummy seal and housed in a single casing.

Description of the Related Art

In response to the demand of more energy saving and environment preservation ($CO_2$ reduction), steam turbine power plants are desired to have a larger capacity and improved thermal efficiency. The thermal efficiency is improved by raising the temperature and the pressure of working steam. The rotation of the turbine rotor generates high stress. Thus, the turbine rotor must withstand high temperature and high stress. While using the working steam of a higher temperature, a cooling technique of the turbine rotor is an important issue.

In accordance with the trend of increasing the capacity of the steam turbine power plants, there is a transition trend from a single-casing steam turbine power plant to a tandem compound steam turbine power plant. In the tandem compound steam turbine power plant, a high pressure turbine, an intermediate pressure turbine, a low pressure turbine and so on are individually housed in separate casings and each shaft of the turbines and the generator are coaxially joined.

This type of generating plant has at least one stage of repeaters in a boiler. The repeater reheats discharge steam having been discharged from each of the steam turbines to supply the reheated steam to the steam turbine on the low-pressure side. The rotor shafts of multiple stages of steam turbines are coaxially joined to the shaft of the generator so as to ensure the stability against the vibration of the rotor shafts.

In contrast, the steam turbine power plant of the tandem compound type adopts the structure of housing different pressure stages of steam turbines in a single casing. By reducing the number of casings, the axial length of the entire rotor can be shorter and the power plant can be downsized. For instance, in the opposed-flow single casing turbine, the high-pressure turbine and the intermediate-pressure turbine are housed in a single casing and dummy seals are interposed between the turbines. A steam supply path is provided across the dummy seal to supply working steam to each of the turbines. Each working steam is streamed in the casing as an opposed-flow to each blade cascade.

One example of the steam turbine power plant with the above structure is illustrated in FIG. 12. FIG. 12 shows a common steam turbine power plant that adopts a two-stage reheating system and has steam turbines of high intermediate pressure opposed-flow single casing type. Hereinafter, ultrahigh-pressure/very high pressure may be referred to as "VHP", high and intermediate pressure may be referred to as "HIP" and low pressure may be referred to as "LP".

FIG. 12 also shows a superheater 21 in a boiler 2. The superheater 21 produces steam. The steam is supplied to a VHP turbine 1 to drive the VHP turbine 1. The discharge steam from the VHP turbine 1 is reheated by a first-stage repeater 22 provided in the boiler to produce HP steam. The HP steam is supplied to a HP turbine part 31 of a HIP turbine of high and intermediate pressure opposed-flow single casing type to drive the HP turbine part 31.

Discharge steam from the HP turbine part 31 is reheated by a second-stage reheater 23 provided in the boiler 2 to produce IP steam. The IP steam is introduced to an IP turbine part 32 of the HIP turbine 3 to drive the IP turbine part 32. Discharge steam from the IP turbine part 32 is introduced to an LP turbine 4 via a crossover pipe 321 to drive the LP turbine 4. Discharge steam from the LP turbine 4 is condensed by a condenser 5, pressurized by a boiler supply pump 6 and then reheated by the superheater 21 of the boiler 21 to produce VHP steam. The VHP steam is circulated to the VHP turbine 1.

JP2000-274208 discloses a steam turbine of the opposed-flow single casing type in a steam turbine power plant of tandem compound type equipped with a boiler with two stage reheater. In the steam turbine of the opposed-flow single casing type, a VHP turbine and a HP turbine or the HP turbine and an IP turbine are housed in the single casing.

In a steam turbine such as the single-casing steam turbine and the high intermediate pressure opposed-flow single casing turbine, steam of high temperature without being used, enters a gap between the rotor shaft and the dummy seal that separates the HP turbine part and IP turbine part. By this, the dummy seal and the rotor shaft becomes exposed to a high temperature atmosphere. Thus, it is an important issue how to cool this area.

For instance in the single casing steam turbine such as the one shown in FIG. 2 to FIG. 5 of JP1-113101U (Utility Model Application) and the one shown in FIG. 2 of JP9-125909A, steam is supplied to the HP turbine part and passes a first-stage stator blades to a first-stage stator blade outlet. The steam out of the first-stage stator blade outlet is introduced to the IP turbine part through the gap between the dummy seal and the rotor shaft. The high temperature area of the dummy seal and the rotor shaft is cooled. The cooling method is described below in reference to FIG. 13.

FIG. 13 is a sectional view near a supply part of the working steam in the HIP turbine 3 of the steam turbine power plant of FIG. 12. In the HIP turbine 3 near the inlet for the HP steam and the IP steam in FIG. 13, a HP turbine blade cascade part 71, a HP dummy part (outer circumferential part) 72, an IP dummy part 73 and an IP turbine blade cascade part 74 are formed on an outer circumferential side of the turbine rotor 7. The HP turbine blade cascade part 71 has HP rotor blades 71*a* disposed at predetermined intervals. HP stator blades 8*a* of a HP blade ring 8 are arranged between the HP rotor blades 71*a*. At the most upstream part of the HP turbine blade cascade part 71, a HP first-stage stator blade 8*a*1 is arranged.

The IP turbine blade cascade part 74 has IP rotor blades 74*a* disposed at predetermined intervals. IP stator blades 9*a* of an IP blade ring 9 are arranged between the IP rotor blades 74*a*. At the most upstream part of the IP turbine blade cascade part 74, an IP first-stage stator blade 9*a*1 is arranged. A dummy ring 10 is provided between the HP blade ring 8 and the IP blade ring 9 to seal the HP turbine part 31 and the IP turbine part 32. Also, a seal fin part 11 is provided in places near the blade rings 8,9, the dummy ring 10 and the turbine rotor 7 so as to suppress the leaking of the steam to those parts.

The dummy ring 10 and the turbine rotor 7 are cooled by streaming a portion of the stream from the exit T of the first-stage stator blade 8*a*1 to an inlet of the IP turbine part 32. Specifically, the portion of the steam from the exit T of the first-stage stator blade 8*a*1 of the HP turbine streams between the HP dummy ring 72*a* and a HP dummy part of the rotor as HP dummy steam 72*c*. The HP dummy steam 72*c* then streams between the IP dummy ring 73*a* and an IP dummy part 73*b* of the rotor as HP dummy steam 73*c*. The IP dummy steam cools an inner surface of the IP dummy ring 73*a* and an IP inlet of the rotor 7.

A steam discharge path 10*a* is arranged in the dummy ring 10 in the radial direction. The HP dummy steam 72*c* is led by thrust balance through the steam discharge path 10*a* to a discharge steam pipe (unshown) of the HP turbine part 31 in the direction shown with an arrow 72*d*.

In this structure, the steam temperature at the exit T of the first-stage stator blade 8*a*1 of the HP turbine part 31 must be lower than the steam temperature at the inlet of the first-stage stator blade 8*a*1 and at the inlet of the first-stage stator blade 9*a*1 of the IP turbine part to cool the area near the inlet part of the HP steam and the IP steam in the HIP turbine 3.

A two stage reheating turbine has VHP-HP-IP-LP structure in which the HP turbine part 31 and the IP turbine part 32 are housed in different casings. In the structure, the inlet parts of the HP turbine and the IP turbine are respectively cooled by the steam from each exit of the first-stage stator blade.

However, in a conventional steam turbine power plant, the steam expands through the HP first-stage stator bade 8*a*1 and is then used as cooling steam. Although the temperature is reduced, the steam from the first-stage stator blade 8*a*1 does not have high cooling effect with respect to the working steam streaming into the HP turbine 31.

In such a case that the steam temperature at the exit T of the first-stage stator blade of the HP turbine part 31 is not less than the steam temperature at the exit of the first-stage stator blade 9*a*1 of the IP turbine part, the steam from the first-stage stator blade 8*a*1 cannot be used as cooling steam for the IP turbine blade cascade part 74. The steam at the exit of the first-stage stator blade of the HP turbine part 31 is the steam before being used in the HP turbine blade cascade part 71 and thus, using the steam as cooling steam is a waste from a perspective of thermal efficiency.

In the single casing steam turbine illustrated in FIG. 1 of JP1-113101U (Utility Model Application), the discharge gas from a HP turbine part is partially supplied to an IP blade cascade part via a pipe 105 as cooling steam.

In the single casing steam turbine illustrated in FIG. 1 of JP9-125909A, the discharge gas from a HP turbine part is supplied to an inlet 44 of an IP turbine part via a thrust balance pipe 106 as cooling steam.

In the steam turbine of high intermediate pressure opposed-flow single casing type disclosed in JP11-141302A, the steam from first-stage rotor blades of a HP turbine part is supplied to a heat exchanger 16 to be cooled by heat exchange with low-temperature steam outside of the casing. The cooled steam is supplied as cooling steam to a clearance between a rotor shaft and a dummy seal isolating the HP turbine part and IP turbine part from each other.

JP2000-274208
JP1-113101U (Utility Model Application)
JP9-125909A
JP11-141302A

SUMMARY OF THE INVENTION

The conventional cooling devices of the steam turbine of a single-casing type that are shown in FIG. 1 of JP1-113101U (Utility Model Application) and FIG. 1 of JP9-125909A mainly cool the inlet part of the intermediate pressure turbine part. The cooling devices are not intended to cool the dummy seal partitioning the high-pressure turbine part and the intermediate-pressure turbine part and the rotor shaft on the inner side of the dummy seal.

Specifically, in these cooling devices, the pressure of the discharge steam of the high-pressure side turbine is set lower than that of the working steam streaming into the clearance between the dummy seal and the rotor shaft through the first-stage stator blade of the high-pressure side turbine part so that the discharge steam streams toward the intermediate-pressure turbine part.

Thus, the discharge steam of the high-pressure turbine part to be supplied as cooling steam and the steam through the first-stage stator blade merge into one and streams toward the intermediate-pressure turbine part to cool the intermediate-pressure turbine part. Therefore, it is impossible to cool the clearance between the dummy seal and the rotor shaft down to the temperature of the exit steam of the first-stage stator blade or below.

In the cooling device disclosed in JP11-141302A, a heat exchanger cools the high-temperature steam which has passed the first-stage stator blade of the high-pressure turbine part but has not worked much, and the steam cooled by the heat exchanger is supplied to the dummy seal portioning the high-pressure turbine part and the low-pressure turbine part. This is inefficient from the perspective of thermal efficiency and high-cost as additional equipment is required.

The high-temperature steam circulates around the turbine rotor and the rotation of the turbine rotor produces high stress. Thus, the turbine rotor must be made of materials that can withstand high temperature and high stress. The turbine rotor is made of Ni-base alloy in the area where it is subjected to high temperature. However, Ni-base alloy is expensive and there is the limit to the manufacturable size. Thus, only for the necessary part, Ni-base alloy is used and for other parts, steel with heat resistance such 12Cr steel, CrMoV steel or the like is used and manufactured separately from the necessary area. The parts made of different materials are then coupled as one.

The parts of different materials are joined by welding or the like and the joint section has lower strength than the rest. In the case where the welding part is disposed on the inner side of the dummy seal portioning each of the steam turbine parts, the welding part is often cooled sufficiently.

In view of the problems of the related art, an object of the present invention is to achieve a cooling device that improves cooling efficiency of a dummy seal and a rotor shaft disposed on the inner side of the dummy seal in a steam turbine generator facility having a steam turbine of an opposed-flow single-casing type in which a plurality of steam turbines are housed in a single casing and the dummy seal partitions each of turbine parts.

To solve the problems above, an aspect of the present invention is a cooling method for a steam turbine generating facility having an opposed-flow single casing steam turbine which is arranged on a higher pressure side than a low pressure turbine and in which a plurality of turbine parts are housed in a single casing and a dummy seal isolates the plurality of turbine parts from one another. The cooling method may include, but is not limited to, the steps of: supplying cooling steam generated in the steam turbine generating facility to a cooling steam supply path formed in the dummy seal, the cooling steam having a temperature lower than a temperature of working steam that is supplied to each of the plurality of turbine parts of the opposed-flow single casing steam turbine and has passed through a first-stage stator blade, the cooling steam having a pressure not less than a pressure of the working steam having passed through the first-stage stator blade, and cooling the dummy seal and a rotor shaft arranged on an inner side of the dummy seal by introducing the cooling steam to a clearance formed between the dummy seal and the rotor shaft via the cooling steam supply path and streaming the cooling steam in the clearance against the steam from an exit of the first-stage stator blade.

In the cooling method, the cooling steam generated in the steam turbine generating facility is supplied to the clearance formed between the dummy seal and the rotor shaft through the cooling steam supply path. The cooling steam has a temperature lower than a temperature of the working steam that is supplied to each of the plurality of turbine parts of the opposed-flow single casing steam turbine and has passed through the first-stage stator blade. This improves the cooling effect of the dummy seal and the rotor shaft in comparison to the conventional cooling method. Also by setting the pressure of the cooling steam not less than that of the working steam having passed through the first-stage stator blade, the cooling steam can be spread in the clearance against the working steam having passed through the first-stage stator blade, thereby further increasing the cooling effect of the dummy seal and the rotor shaft.

In this manner, it is possible to prevent the temperature rise of the dummy seal and the turbine rotor and to increase the freedom of choosing materials to be used in these parts as well as keeping the maintenance of these part. Particularly, it is possible to reduce the size of Ni-base alloy part of the turbine rotor which is made of Ni-base alloy or the like and used in a high-temperature area, thereby making the production of the turbine rotor easier.

In the aspect of the present invention, other types of steam generated in the steam turbine generator facility can be used as cooling steam, thereby positively achieving the cooling effect.

The cooling method may preferably further include the step of: after the step of cooling the dummy seal and the rotor shaft, discharging the cooling steam via a cooling steam discharge path formed in the dummy seal to a discharge steam pipe to supply steam to a subsequent steam turbine. The opposed-flow single casing steam turbine includes a high-pressure side turbine part and a low-pressure side turbine part. The high-pressure side turbine part and the low-pressure side turbine part have different pressures of the working steam. This prevents the cooling steam from stagnating in the clearance after cooling the dummy seal and the rotor shaft and also makes the replacement of the cooling steam smooth, thereby improving the cooling effect of the dummy seal and the rotor shaft. The cooling steam having cooled the dummy seal and the rotor shaft is discharged from the cooling steam discharge path. Thus, even if the turbine parts have different pressures of the working steam, the thrust balance of the turbine rotor can be maintained.

In the cooling method of the aspect of the present invention, the cooling steam supply path may open to the clearance on a side nearer to the low-pressure side turbine part than the cooling steam discharge path, and the cooling steam may be streamed in the clearance against steam from an exit of the first-stage stator blade of the low-pressure side turbine part and then discharged via the cooling steam discharge path with steam that branches from an exit of the first-stage stator blade of the high-pressure side turbine part.

As described above, the cooling steam is streamed in the clearance and then discharged via the cooling steam discharge path with the steam that branches from the exit of the first-stage stator blade of the high-pressure side turbine part. Thus, the cooling steam can be spread rapidly throughout the clearance, thereby improving the cooling effect.

In such a case that the rotor shaft is formed by joining split members that are made of different materials and a joint section at which the split members are joined to form the rotor shaft is formed facing the clearance, it is possible to improve the cooling effect of the joint section which has low high-temperature strength according to the cooling method of the present invention. This can prevent the strength decrease of the joint section.

As a cooling device that can be used directly to achieve the cooling method of the aspect of the present invention, another aspect of the present invention is a cooling device for a steam turbine generating facility having an opposed-flow single casing steam turbine which is arranged on a higher pressure side than a low pressure turbine and in which a plurality of turbine parts are housed in a single casing and a dummy seal isolates the plurality of turbine parts from one another. The cooling device may include, but is not limited to: a cooling steam supply path which is formed in the dummy seal and opens to a clearance between the dummy seal and a rotor shaft arranged on an inner side of the dummy seal; and a cooling steam pipe which is connected to the cooling steam supply path to supply cooling steam generated in the steam turbine generating facility to the cooling steam supply path, the cooling steam having a temperature lower than that of working steam that is supplied to each of the plurality of turbine parts of the opposed-flow single casing steam turbine and has passed through a first-stage stator blade, the cooling steam having a pressure not less than that of the working steam at the exit. The cooling steam may be streamed into the clearance between the dummy seal and the rotor shaft via the cooling steam supply path to cool the dummy seal and the rotor shaft.

In the cooling device, the cooling steam generated in the steam turbine generating facility is supplied to the clearance formed between the dummy seal and the rotor shaft through the cooling steam supply path. The cooling steam has a temperature lower than a temperature of the working steam that is supplied to each of the plurality of turbine parts of the opposed-flow single casing steam turbine and has passed through the first-stage stator blade. This improves the cooling effect of the dummy seal and the rotor shaft in comparison to the conventional cooling device.

Further, by setting the pressure of the cooling steam not less than that of the working steam having passed through the first-stage stator blade, the cooling steam can be spread in the clearance against the working steam having passed through the first-stage stator blade, thereby further increasing the cooling effect of the dummy seal and the rotor shaft.

In this manner, it is possible to prevent the temperature rise of the dummy seal and the turbine rotor and to increase the freedom of choosing materials to be used in these parts as well as being able to maintain these part. Particularly, it is possible to reduce the size of Ni-base alloy part of the turbine rotor which is made of Ni-base alloy or the like and used in a high-temperature area, thereby making the production of the turbine rotor easier.

In the other aspect of the present invention, other types of steam generated in the steam turbine generator facility can be used as cooling steam, thereby positively achieving the cooling effect.

Preferably, in the cooing device of the other aspect of the present invention, in such a case that the opposed-flow single casing steam turbine includes a high-pressure side turbine part and a low-pressure side turbine part, the high-pressure side turbine part and the low-pressure side turbine part having different pressures of the working steam, a cooling steam discharge path may be formed in the dummy seal and opens to the clearance, a discharge steam may be connected to the cooling steam discharge path to supply steam from the cooling steam discharge path to a subsequent steam turbine, and the cooling steam may be introduced to the clearance to cool the dummy seal and the rotor shaft and then discharged from the cooling steam discharge path to the discharge steam pipe that supplies the steam to the subsequent steam turbine.

This prevents the cooling steam from stagnating in the clearance after cooling the dummy seal and the rotor shaft and also makes the replacement of the cooling steam smooth, thereby improving the cooling effect of the dummy seal and the rotor shaft. The cooling steam having cooled the dummy seal and the rotor shaft is discharged from the cooling steam discharge path. Thus, even if the turbine parts have different pressures of the working steam, the thrust balance of the turbine rotor can be maintained.

In the cooling device of the other aspect of the present invention, it is preferable that the cooling steam supply path opens to the clearance on a side nearer to the low-pressure side turbine part than the cooling steam discharge path, and the cooling steam is streamed in the clearance against steam from an exit of the first-stage stator blade of the low-pressure side turbine part and then discharged via the cooling steam discharge path with steam that branches at an exit of the first-stage stator blade of the high-pressure side turbine part and streams into the clearance on a side of the high-pressure side turbine part.

As described above, the cooling steam is streamed in the clearance and then discharged via the cooling steam discharge path with the steam that branches from the exit of the first-stage stator blade of the high-pressure side turbine part. Thus, the cooling steam can be spread rapidly throughout the clearance, thereby improving the cooling effect.

In the cooling device, it is also preferable that a very-high-pressure turbine is provided, the high-pressure side turbine part of the opposed-flow single casing steam turbine is a high-pressure turbine, the low-pressure side turbine part of the opposed-flow single casing steam turbine is a low-pressure turbine, and part of discharge steam or extraction steam of the very-high-pressure turbine is supplied to the cooling steam supply path as the cooling steam.

The discharge steam having worked in the very-high-pressure turbine or the extraction steam has a temperature much lower than that of the exit steam of the first-stage stator blade of the high-pressure turbine part, which is used as cooling steam in the conventional cooling method. Thus, by using the discharge steam or the extraction steam as cooling steam, it is possible to improve the cooling effect of the dummy seal and the rotor shaft.

In the cooling device, it is also preferable that part of discharge steam or extraction steam of the high-pressure side turbine part of the opposed-flow single casing steam turbine is supplied to the cooling steam supply path as the cooling steam. The discharge steam or extraction steam of the high-pressure side turbine part is the steam having been through the high-pressure side turbine part and has a temperature much lower than that of the exit steam of the first-stage stator blade of the high-pressure turbine, which is used as cooling steam in the conventional cooling method.

Thus, by using the discharge steam or the extraction steam as cooling steam, it is possible to improve the cooling effect of the dummy seal and the rotor shaft.

The cooling device may further include a superheater in a boiler to superheat steam. The steam extracted from the superheater may be supplied to the cooling steam supply path as the cooling steam.

The extraction steam extracted from the superheater of the boiler has a temperature much lower than that of the exit steam of the first-stage stator blade of the high-pressure turbine, which is used as cooling steam in the conventional cooling method.

Thus, by using the discharge steam or the extraction steam as cooling steam, it is possible to improve the cooling effect of the dummy seal and the rotor shaft.

The cooling device may also include a reheater which is provided in a boiler to reheat discharge steam from a steam turbine and reheated steam extracted from the reheater may be supplied to the cooling steam supply path as the cooling steam.

The extraction steam extracted from the superheater of the boiler has a temperature much lower than that of the exit steam of the first-stage stator blade of the high-pressure turbine part, which is used as cooling steam in the conventional cooling method.

Thus, by using the discharge steam or the extraction steam as cooling steam, it is possible to improve the cooling effect of the dummy seal and the rotor shaft.

The cooling device may also include a high-pressure turbine having a first high-pressure turbine part on a high temperature and high pressure side and a second high-pressure turbine on a low temperature and low pressure side, an intermediate-pressure turbine which comprises a first intermediate-pressure turbine part on a high temperature and high pressure side and a second intermediate-pressure turbine part on a low temperature and low pressure side, and a boiler which comprises a superheater to superheat steam. The first high-pressure turbine part and the first intermediate-pressure turbine part may be constructed as the opposed-flow single casing steam turbine and the cooling steam supply path is formed in the dummy seal, and steam extracted from the superheater may be supplied to the cooling steam supply path as the cooling steam.

In the above structure, extraction steam of the superheater is used as the cooling steam for cooling the rotor shaft and the dummy seal portioning the first intermediate-pressure turbine part and the first high-pressure turbine part. The extraction steam is the steam that is heated by the superheater and extracted from midway of the superheater and has a temperature much lower than that of the working steam at the inlet part of the first intermediate turbine part. The extraction steam of the superheater is extracted before the being heated to a setting temperature in the boiler. The extraction steam has a temperature much lower than that of the steam having through the first-stage stator blade of the high-pressure turbine part as in the case of the conventional cooling method. By using the extraction steam as cooling steam, it is possible to achieve sufficient cooling effect.

The cooling device may further include a high-pressure turbine, an intermediate-pressure turbine which includes a first intermediate-pressure turbine part on a high temperature and high pressure side and a second intermediate-pressure turbine part on a low temperature and low pressure side and a boiler which comprises a superheater to superheat steam. The high-pressure turbine and the second intermediate-pressure turbine part may be constructed as the opposed-flow single casing steam turbine and the cooling steam supply path is formed in the dummy seal. Steam extracted from the superheater may be supplied to the cooling steam supply path as the cooling steam.

In the above structure, the extraction steam of the superheater is used as cooling steam to cool the dummy seal portioning the high-pressure turbine and the second intermediate-pressure turbine part and the rotor shaft disposed on the inner side of the dummy seal. The extraction steam of the superheater has a temperature much lower than that of the working steam at the inlet part of the high-pressure turbine or the second intermediate-pressure turbine part. Thus, it is possible to improve the cooling effect of the dummy seal and the rotor shaft in comparison to the conventional case. The extraction steam is the steam that is extracted before being heated to a setting temperature in the boiler. The extraction steam has a temperature much lower than that of the steam having passed through the first-stage stator blade of the high-pressure turbine part as in the case of the conventional cooling method.

The cooling device may further include a high-pressure turbine which comprises a first high-pressure turbine part on a high temperature and high pressure side and a second high-pressure turbine on a low temperature and low pressure side; and an intermediate-pressure turbine which comprises a first intermediate-pressure turbine part on a high temperature and high pressure side and a second intermediate-pressure turbine part on a low temperature and low pressure side. The first high-pressure turbine part and the first intermediate-pressure turbine part may be constructed as the opposed-flow single casing steam turbine and the cooling steam supply path is formed in the dummy seal. The cooling steam discharge path may be formed in the dummy seal and connected to a discharge steam pipe of the first high-pressure turbine part. The steam extracted from between blade cascades of the first high-pressure turbine part may be supplied to the cooling steam supply path as the cooling steam and the steam from an exit of a first-stage stator blade of the first high-pressure turbine part is supplied to the clearance as the cooling steam, both of the cooling steams joining to be discharged from the discharge steam pipe via the cooling steam discharge path.

In the above structure, the extraction steam of the first high-pressure turbine part is used as cooling steam to cool the dummy seal and the rotor shaft. The extraction steam of the first high-pressure turbine part has a temperature much lower than that of the working steam in the inlet part of the first high-pressure turbine part. The extraction steam of the first high-pressure turbine part is the steam having worked in the turbine rotor. In comparison to the conventional cooling method using the steam having passed through the first-stage stator blade of the high-pressure turbine part as cooling steam, the temperature of the extraction steam of the first-stage high-pressure turbine is much lower. Thus, it is possible to cool the dummy seal and the rotor shaft more efficiently than the conventional case.

In addition to the cooling effect by the extraction steam of the first high-pressure turbine part, the working steam inlet part of the first high-pressure turbine is cooled by the steam having passed through the first-stage stator blade of the first high-pressure turbine part. As a result, it is possible to further improve the cooling effect of the dummy seal and the rotor shaft.

The extraction steam having cooled the dummy seal and the rotor shaft and the steam having passed through the first-stage stator blade are joined and discharged through the cooling steam discharge path. This prevents the cooling steam from stagnating in the clearance after cooling the dummy seal and the rotor shaft and also favorably maintains the thrust balance of the turbine rotor as well as sustaining the cooling effect.

In addition to the above structure, the cooling device may further include a cooling unit which cools extraction steam extracted from between the blade cascades of the first high-pressure turbine part. The extraction steam may cooled by the cooling unit and then supplied to the cooling steam supply path as the cooling steam.

The cooling unit may include, for instance, finned tubes or spiral tubes through which the extraction steam streams. A fan may be used in combination to send cold air to the tubes to cool the extraction steam. Alternatively, the cooling unit may have a double tube structure in which the extraction steam is fed to one space and the cooling water is fed to other space to cool the extraction steam. This can further improve the cooling effect.

According to the cooling method of the aspect of the present invention, the cooling method for a steam turbine generating facility having an opposed-flow single casing steam turbine which is arranged on a higher pressure side than a low pressure turbine and in which a plurality of turbine parts are housed in a single casing and a dummy seal isolates the plurality of turbine parts from one another, may include, but is not limited to, the steps of: supplying cooling steam generated in the steam turbine generating facility to a cooling steam supply path formed in the dummy seal, the cooling steam having a temperature lower than a temperature of working steam that is supplied to each of the plurality of turbine parts of the opposed-flow single casing steam turbine and has passed through a first-stage stator blade, the cooling steam having a pressure not less than a pressure of the working steam having passed through the first-stage stator blade, and cooling the dummy seal and a rotor shaft arranged on an inner side of the dummy seal by introducing the cooling steam to a clearance formed between the dummy seal and the rotor shaft via the cooling steam supply path and streaming the cooling steam in the clearance against the steam from an exit of the first-stage stator blade. This does not require a lot of equipment and still improves the cooling effect of the dummy seal and the rotor shaft.

This improves maintenance effect of the dummy seal and the turbine rotor and increases the freedom of choosing materials to be used in these parts. In particular, it is possible to reduce the size of a part of the turbine rotor that is made of Ni-base alloy to be used in a high-temperature area, thereby making the production of the turbine rotor easier.

By cooling the dummy seal and the rotor shaft, it is possible to provide strength in a welding part whose strength is expected to be lower than that of a base material in the case of adopting a welding structure in a rotating part or a stationary part around the dummy seal and the rotor shaft. This provides more freedom in the strength design of the welding part.

According to the cooling device of the other aspect of the present invention, the cooling device for a steam turbine generating facility having an opposed-flow single casing steam turbine which is arranged on a higher pressure side than a low pressure turbine and in which a plurality of turbine parts are housed in a single casing and a dummy seal isolates the plurality of turbine parts from one another, may include, but not limited to: a cooling steam supply path which is formed in the dummy seal and opens to a clearance between the dummy seal and a rotor shaft arranged on an inner side of the dummy seal; and a cooling steam pipe which is connected to the cooling steam supply path to supply cooling steam generated in the steam turbine generating facility to the cooling steam supply path, the cooling steam having a temperature lower than that of working steam that is supplied to each of the plurality of turbine parts of the opposed-flow single casing steam turbine and has passed through a first-stage stator blade, the cooling steam having a pressure not less than that of the working steam at the exit. The cooling steam may be streamed into the clearance between the dummy seal and the rotor shaft via the cooling steam supply path to cool the dummy seal and the rotor shaft. As a result, it is possible to achieve the same effects as the cooling method of the aspect of the present invention.

DETAILED DESCRIPTION OF THE INVENTION

A preferred embodiment of the present invention will now be described in detail with reference to the accompanying drawings. It is intended, however, that unless particularly specified, dimensions, materials, shape, its relative positions and the like shall be interpreted as illustrative only and not limitative of the scope of the present invention.

First Preferred Embodiment

Figure 1:
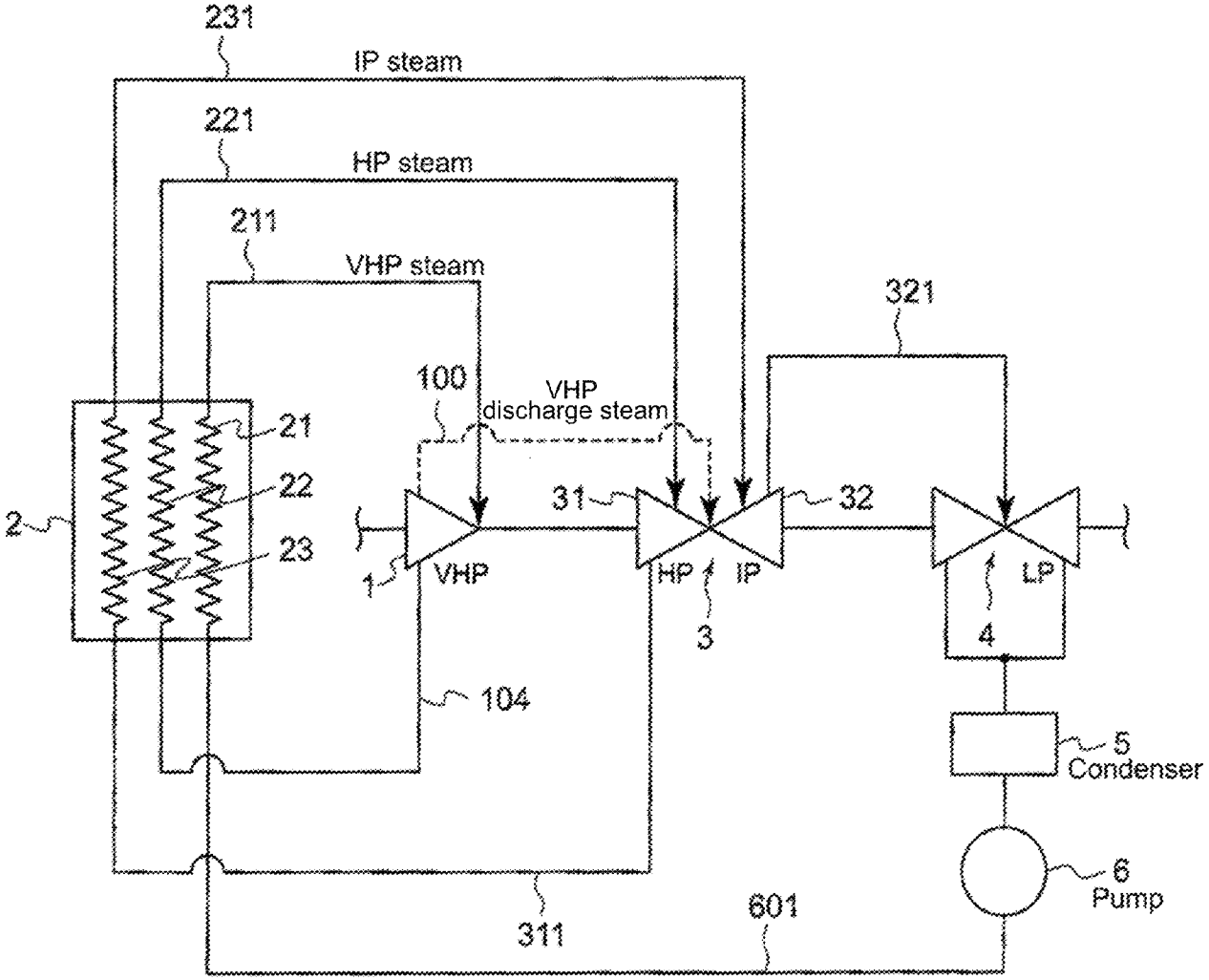
FIG. 1 is a systematic diagram showing a first preferred embodiment of a steam turbine power plant to which the present invention is applicable.
Figure 2:
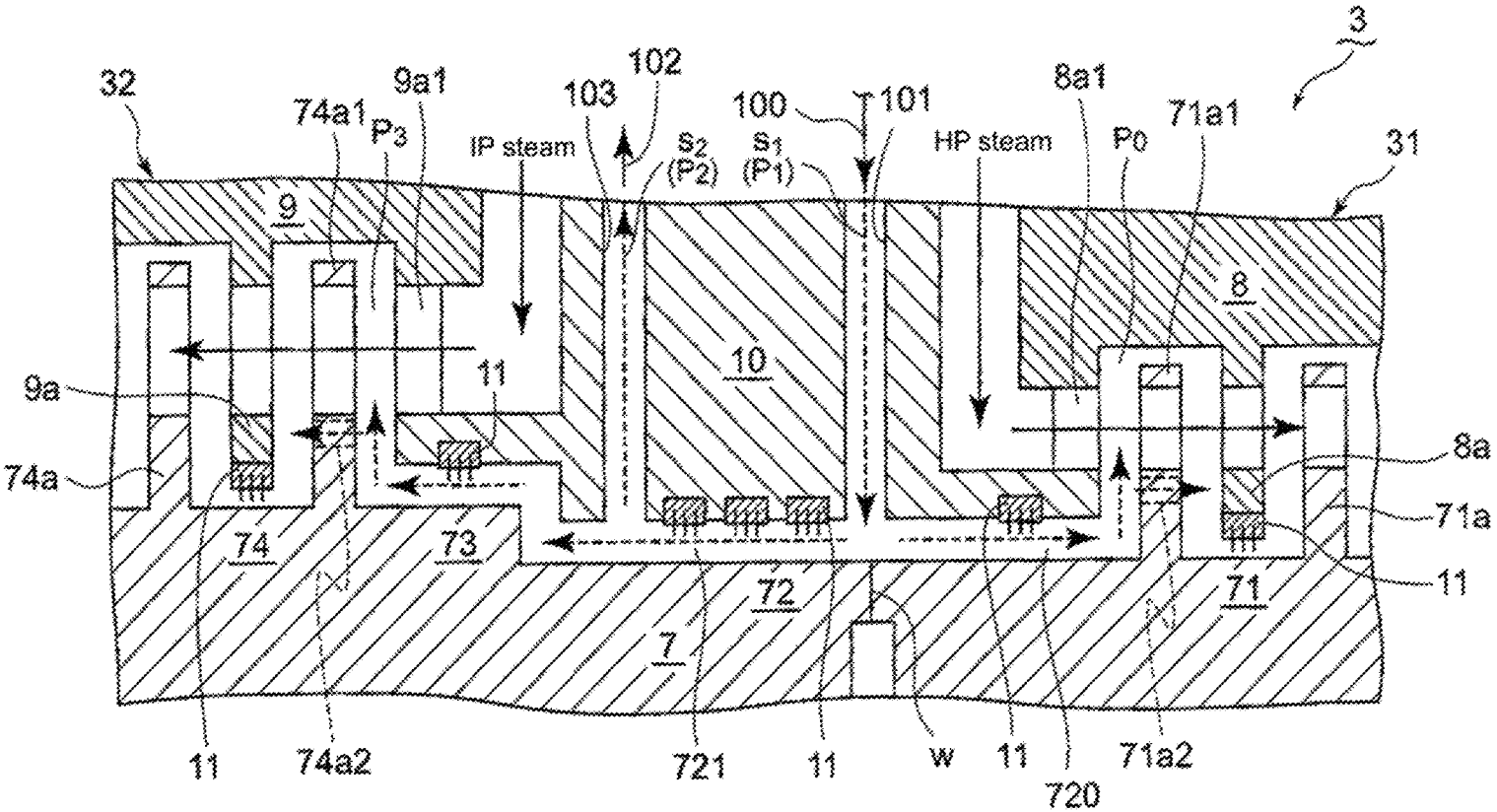
FIG. 2 is a sectional view of a structure of a working steam inlet part of a HIP turbine 3 of FIG. 1.

FIG. 1 and FIG. 2 illustrate a first preferred embodiment of a steam turbine power plant to which the present invention is applicable. FIG. 1 shows a steam turbine power plant having a VHP turbine 1, a two-stage reheater boiler 2 having a superheater 21, a first-stage reheater 22 and a second-stage reheater 23, a steam turbine 3 of HIP opposed-flow single casing type and a LP turbine 4 (VHP-HIP-LP configuration). The steam turbine 3 of high intermediate pressure opposed-flow single casing type has a HP turbine part 31 and an IP turbine part 32 that are installed securely to a shaft of a turbine rotor and housed in a single casing. The steam turbine 3 of high intermediate pressure opposed-flow single casing type is referred to as the HIP turbine 3 hereinafter.

VHP steam (e.g. 700° C.) generated in the superheater 21 of the boiler 2 is introduced to the VHP turbine 1 via a steam pipe 211 so as to drive the VHP turbine 1. Part of discharge steam (e.g. 500° C.) of the VHP turbine 1 is sent to the first-stage reheater 22 of the boiler 2 via a discharge steam pipe 104 so to be reheated to produce HP steam (e.g. 720° C.). The remaining part of the discharge steam of the VHP turbine 1 is supplied to the HIP turbine 3 via a steam communication pipe 100.

Next, the HP steam generated in the boiler 2 is introduced to the HP turbine part 31 via a steam pipe 221 to drive the HP turbine part 31. Discharge steam of the HP turbine part 31 is sent to the second-stage reheater 23 of the boiler 2 via a discharge steam pipe 311 to produce IP steam (e.g. 720° C.). The IP steam is introduced to the IP turbine part 32 via a steam pipe 231 to drive the IP turbine part 32. Discharge steam of the IP turbine part 32 is introduced to the LP turbine via a crossover pipe 321 to drive the LP turbine 4. Discharge steam of the LP turbine 4 is condensed by a condenser 5, returned to the superheater 21 of the boiler 2 via a condensate pipe 601 by means of a boiler supply pump 6 and then superheated by the superheater 21 to produce the VHP steam again. The VHP steam is circulated to the VHP turbine 1.

FIG. 2 shows a structure near the working steam inlet part of the HIP turbine 3. In the HIP turbine 3 near the inlet for the HP steam and the IP steam, a HP turbine blade cascade part 71, a HP dummy part 72, a IP dummy part 73 and an IP turbine blade cascade part 74 are formed on an outer circumferential surface of the turbine rotor 7. The HP turbine blade cascade part 71 has HP rotor blades 71*a* disposed at predetermined intervals. HP stator blades 8*a* of a HP blade ring 8 are arranged between the HP rotor blades 71*a*. At the most upstream part of the HP turbine blade cascade part 71, a HP first-stage stator blade 8*a*1 is arranged.

The IP turbine blade cascade part 74 has IP rotor blades 74*a* disposed at predetermined intervals. IP stator blades 9*a* of an IP blade ring 9 are arranged between the IP rotor blades 74*a*. At the most upstream part of the IP turbine blade cascade part 74, an IP first-stage stator blade 9*a*1 is arranged. A dummy ring 10 is provided between the HP blade ring 8 and the IP blade ring 9 to seal the HP turbine part 31 and the IP turbine part 32. Also, a seal fin part 11 is provided in such places to face the blade rings 8,9, the dummy ring 10 and the turbine rotor 7 so as to suppress the leaking of the steam to those parts. The seal fin parts may be labyrinth seal.

In the first preferred embodiment, a cooling steam supply path 101 is formed in the dummy ring 10 in the radial direction nearer to the HP turbine part 31. The cooling steam supply path 101 is connected to the steam communication pipe 100. The discharge steam $s_1$ from the VHP turbine 1 is supplied to the cooling steam supply path 101 as cooling steam via the cooling steam communication pipe 100. The pressure of the discharge steam $s_1$ is set not less than that of HP exit steam or IP exit steam. The HP exit steam is the HP steam that has passed through the first-stage stator blade 8*a*1 and the IP exit steam is the IP steam that has passed through the first-stage stator blade 9*a*1. The temperature of the discharge steam $s_1$ is set lower than that of the HP exit steam and that of the IP exit steam.

The cooling steam supply path 101 opens to the outer circumferential surface 72 of the turbine rotor and thus, the discharge steam $s_1$ can reach the outer circumferential surface 72 of the turbine rotor 7. The discharge steam $s_1$ branches into both axial directions of the turbine rotor to stream into clearances 720 and 721 between the dummy ring 10 and the turbine rotor 7. The discharge steam $s_1$ streams toward the HP turbine blade cascade part 71 and the IP turbine blade cascade part 74 through the clearances 720 and 721. In this manner, the discharge steam $s_1$ reaches the HP turbine blade cascade part 71 and the IP turbine blade cascade part 74.

A cooling steam discharge path is formed in the radial direction in the dummy ring on a side nearer to the IP turbine part 32 than the cooling steam supply path 101. One end of the cooling steam discharge path 103 is connected to the cooling steam discharge pipe 311 via a discharge steam pipe 102 and other end thereof is opens to the clearance 721.

In the preferred embodiment, as shown in FIG. 2, the pressure of the HP exit steam from the first-stage stator blade 8*a*1 of the HP turbine part 31, the pressure of the discharge steam $s_1$ of the VHP turbine 1, the pressure of discharge steam $s_2$ that is the HP steam having passed through the first-stage stator blade 8*a*1 and reached the cooling steam discharge path 103, and the pressure of the IP exit steam from the first-stage stator blade 9*a*1 of the IP turbine part 32 are respectively described as $P_0$, $P_1$, $P_2$ and $P_3$. And each of the pressures satisfies the relationship shown as a formula (1) below.

$$P_1 \geq P_0 > P_2 > P_3 \quad (1)$$

The discharge steam $s_1$ has the pressure not less than the pressure of the HP discharge steam streaming into the clearance 720 and the pressure of the IP discharge steam streaming into the clearance 721. Thus, the discharge steam $s_1$ can be spread throughout the clearances 720 and 721. In this manner, the discharge steam $s_1$ cools the dummy ring 10 facing the clearances 720 and 721 and the HP dummy part 72 of the turbine rotor 7.

Part of the discharge steam $s_1$ is led by thrust balance to the cooling steam discharge path 103 as the discharge steam $s_2$. The discharge steam $s_2$ is discharged to the discharge steam pipe 311 from the discharge steam pipe connected to the cooling steam discharge path 103. The HP turbine blade cascade part 71 and the IP turbine blade cascade part 74 respectively have cooling holes 71*a*2 and 74*a*2 for streaming the discharge steam s1. Each of the cooling holes 71*a*2 and 74*a*2 is formed in a bottom part or the like of a blade groove of the first rotor blades 71*a*1 and 74*a*1. Thus, part of the discharge steam $s_1$ can reach each cascade of the HP turbine blade cascade part 71 and the IP turbine blade cascade part 74.

In the preferred embodiment, part of the discharge steam $s_1$ (e.g. 500° C.) of the VHP turbine 1 whose temperature is much lower than that of the working steam (e.g. 720° C.) at the inlet of the IP turbine part 32, streams into the clearance 720 between the dummy part 72 of the rotor 7 and the dummy ring 10 from the cooling steam supply path 101. The part of the discharge steam $s_1$ streams to the vicinity of the working steam inlet part of the HIP turbine 3 and thus, it is possible to cool the dummy ring 10 facing the clearance 720 and the dummy part of the turbine rotor 7 more effectively than before. This is due to the fact that the discharge steam $s_1$ of the VHP turbine 1 is the steam having worked in the VHP turbine 1 and has a temperature much lower than the exit steam from the first stator blade 8*a*1 of the HP turbine part 31, which is used as cooling steam in a conventional cooling method.

It is possible to improve the maintenance effect of the dummy part 72 of the turbine rotor 7 and the dummy ring 10 as well as to increase the freedom of choosing materials to be used in these parts. Particularly, it is possible to reduce the size of Ni-base alloy part of the turbine rotor 7 which is made of Ni-base alloy or the like and used in a high-temperature area, thereby making the production of the turbine rotor 7 easier.

By cooling the dummy ring 10 and the HP dummy part 72 of the turbine rotor 7, it is possible to provide strength in a welding part whose strength is expected to be lower than that of a base material in the case of adopting a welding structure in a rotating part or a stationary part around the dummy ring 10 and the dummy part 72. This provides more freedom in the strength design of the welding part.

Part of the discharge steam $s_1$ streams into the clearance 721 nearer to the IP turbine part 32 than the cooling steam supply path 101, so as to cool the dummy ring facing the clearance 721 and the IP dummy part 73. Further, part of the discharge steam $s_1$ reaches each blade cascade of the HP turbine blade cascade part 71 and the IP turbine blade cascade part through the cooling holes 71*a*2 and 74*a*2 so as to cool the HP turbine blade cascade part 71 and the IP turbine blade cascade part 74. This gives the blade cascade more freedom in terms of selection of materials, a strength design and a material design, resulting in facilitating an actual turbine design.

For instance, FIG. 2 shows the case in which the turbine rotor 7 is formed by joining split members that are made of different materials at a welding part w by welding. For instance, the split member on HP turbine part 31 side is made of Ni-base alloy and the split member on the IP turbine part 21 side is made of Ni-base alloy or 12Cr steel. In that case, the cooling steam supply path 101 opens to the clearance near the welding part w and supplies the discharge steam $s_1$ so as to sufficiently cool the welding part having lower strength than other parts. Thus, the strength of the welding part w can be maintained.

Figure 3A:
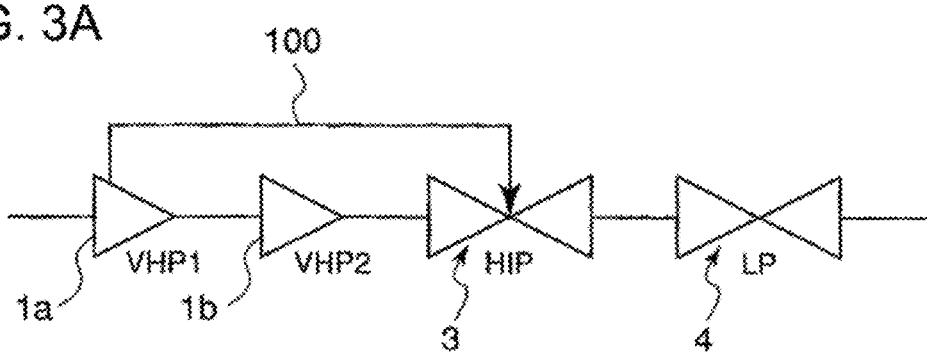
FIG. 3A illustrates a modified example of the first preferred embodiment, which is an example of a three-stage reheater power plant.

In the first preferred embodiment, the example of using one VHP turbine 1 is explained. However, it is possible to apply the invention to a steam turbine power plant having a repeater system of three stages or more in which a plurality of VHP turbines are connected in series. For instance, FIG. 3A shows two VHP turbines 1*a* and 1*b* connected in series. In this exemplary case, the cooling steam is supplied from the first-stage VHP turbine 1*a* (VHP1) to the HIP turbine 3 via the steam communication pipe 100. Alternatively, the cooling steam may be supplied from the second-stage VHP turbine 1*b* (VHP2) to the HIP turbine 3 via the steam communication pipe 100.

Figure 3B:
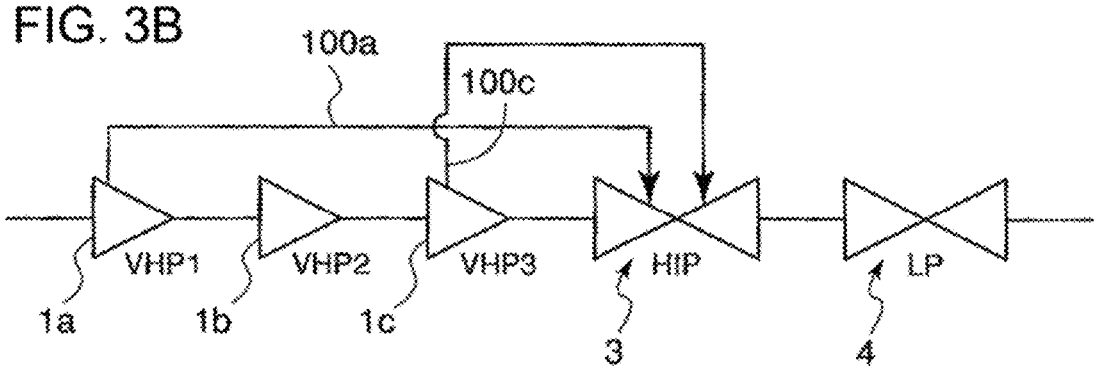
FIG. 3B illustrates another modified example of the first preferred embodiment, which is an example of a four-stage reheater power plant.

FIG. 3B shows three VHP turbines connected in series. In this exemplary case, the cooling steam is supplied to the HIP turbine 3 from the first-stage VHP turbine 1*a* (VHP1) and the third-stage VHP turbine 1*c* (VHP3) via steam communication pipes 100*a* and 100*c* respectively.

Providing more than one VHP turbine allows one to arbitrarily choose which VHP turbine to take discharge steam from to be used as the cooling steam, thereby increasing the freedom of design. When there are plural stages of VHP turbines, the working steam pressure on the turbine blade cascade decreases toward the downstream side. Herein, all the VHP turbines are described as VHP turbines for convenience's sake.

Second Preferred Embodiment

Figure 4:
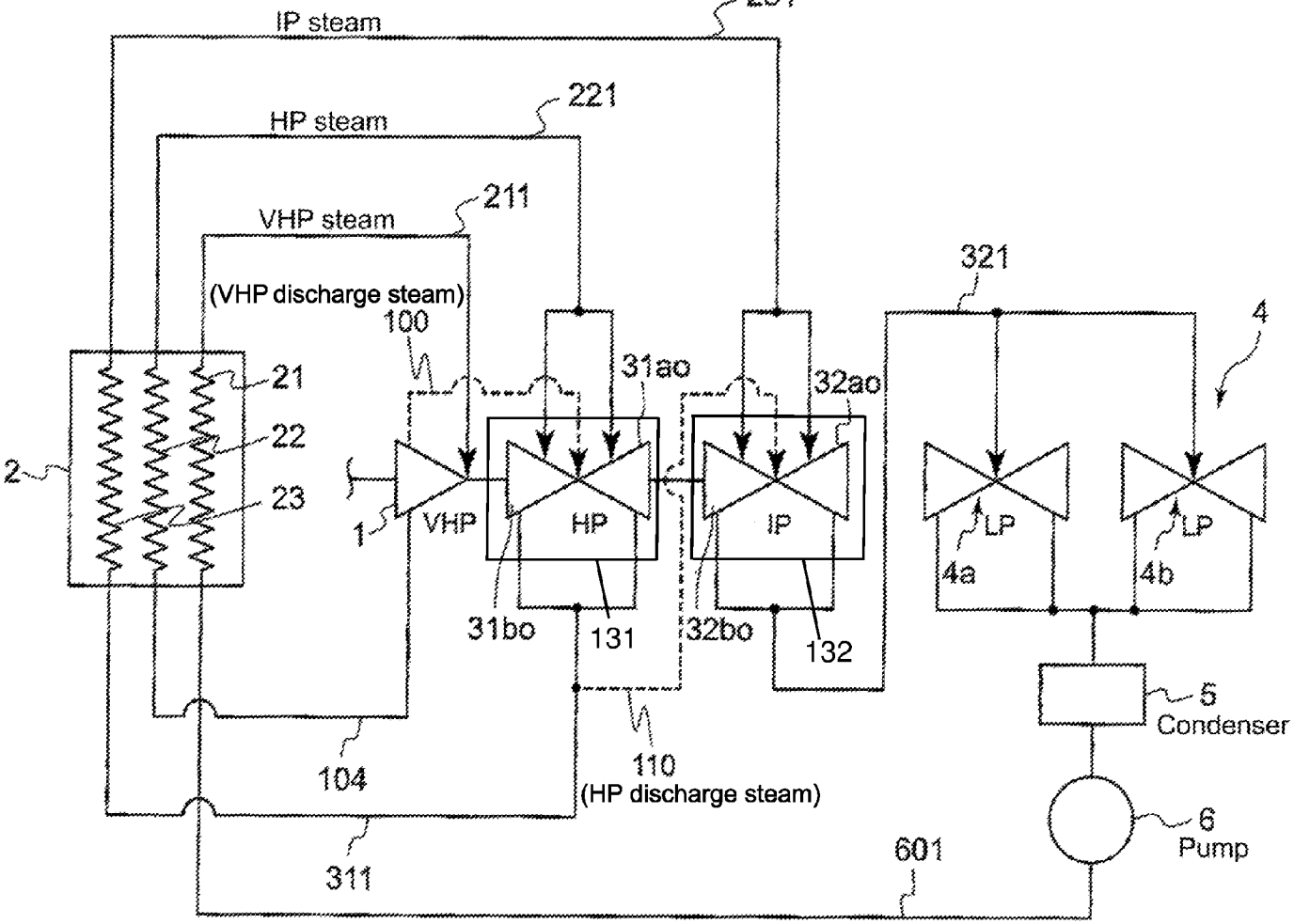
FIG. 4 is a systematic diagram showing a second preferred embodiment of a steam turbine power plant to which the present invention is applicable.
Figure 5:
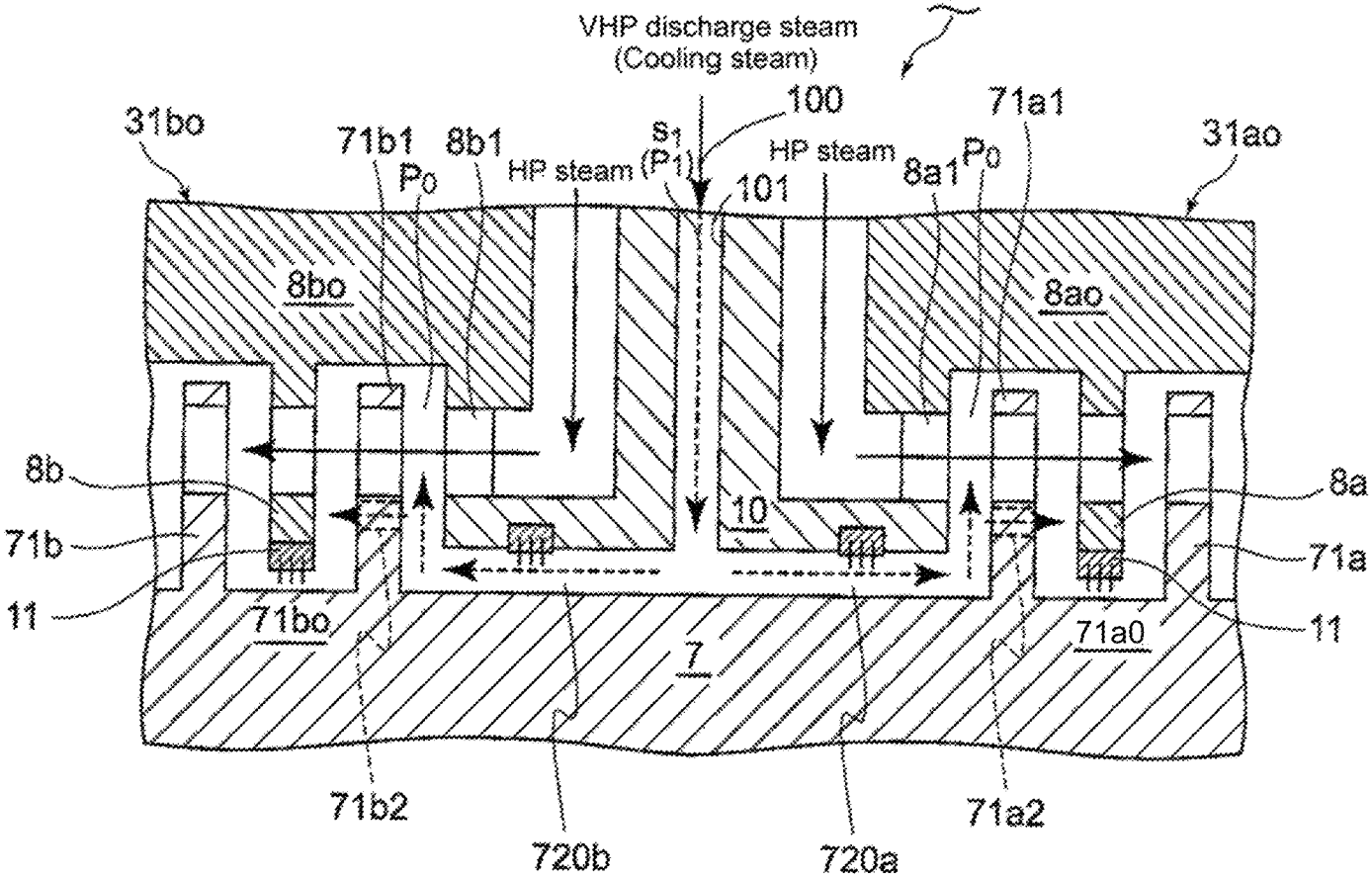
FIG. 5 is a sectional view of a structure of a working steam inlet part of a HP turbine 131 of FIG. 4.

FIG. 4 and FIG. 5 show a second preferred embodiment of a steam turbine power plant to which the present invention is applicable. The steam turbine generating facility of the preferred embodiment includes the VHP turbine 1, a steam turbine 131 of HP opposed-flow single casing type (hereinafter referred to as HP turbine 131) having two HP turbine parts 31*a*0 and 31*b*0 in a single casing to form opposed-flows, a steam turbine 132 of IP opposed-flow single casing type (hereinafter referred to as IP turbine 132) having two IP turbine parts 32*a*0 and 32*b*0 in a single casing to form opposed-flows and two LP turbines 4*a* and 4*b* (VHP-HP-IP-LP).

VHP steam generated in the superheater 21 of the boiler 2 (e.g. 700° C.) is supplied to the VHP turbine as working steam to drive the VHP turbine 1. Discharge steam of the VHP turbine 1 (e.g. 500° C.) is returned to the boiler 2 via the discharge steam pipe 104 and reheated by the first-stage reheater 22. The HP steam reheated by the first-stage reheater 22 (e.g. 720° C.) is supplied to the high-pressure turbine parts 31*a*0 and 31*b*0 of the HP turbine 131 respectively as working steam and drives the high-pressure turbine parts 31*a*0 and 31*b*0. Discharge steam of the high-pressure turbine parts 31*a*0 and 31*b*0 (e.g. 500° C.) is returned to the boiler 2 via the discharge steam pipe 311 and reheated by the second-stage reheater 23.

IP steam reheated by the second-stage repeater (e.g. 720° C.) is supplied to the IP turbine parts 32*a*0 and 32*b*0 of the IP turbine 132 respectively as working steam and drives the IP turbine parts 32*a*0 and 32*b*0. Discharge steam of the IP turbine parts 32*a*0 and 32*b*0 is respectively supplied to the LP turbines 4*a* and 4*b* as working steam via the discharge steam pipe 321 to drive the LP turbines 4*a* and 4*b*.

In the preferred embodiment, part of the discharge stem of the VHP turbine 1 (e.g. 500° C.) is supplied to the HP turbine 131 as cooling steam via the steam communication pipe 100 so as to cool the vicinity of the inlet part of the high-temperature steam (working steam) of the HP turbine 131. Part of the discharge steam of the HP turbine 131 is supplied to the IP turbine 132 as cooling steam via the steam communication pipe 110 so as to cool the vicinity of the working steam inlet part of the IP turbine 132.

FIG. 5 shows a structure of the working steam inlet part of the HP turbine 131 of FIG. 4. As shown in FIG. 5, the HP turbine 131 has HP turbine blade cascade parts 71*a*0 and 71*b*0 arranged substantially symmetric around the turbine rotor 7. The HP turbine blade cascade parts 71*a*0 and 71*b*0 have HP rotor blades 71*a* and 71*b* disposed at equal intervals. Between the HP rotor blades 71*a* and 71*b*, HP stator blades 8*a* and 8*b* of HP blade ring 8*a*0 and 8*b*0 are arranged.

At the most upstream part of the HP turbine blade cascade parts 71*a*0 and 71*b*0, HP first-stage stator blades 8*a*1 and 8*b*1 are arranged. A dummy ring is provided between the left and right HP turbine blade cascade parts 71*a*0 and 71*b*0 to seal the space between the HP steam inlet parts of the HP turbine parts 31*a*0 and 31*b*0. Also, a seal fin part 11 is provided in places near the HP blade rings 8*a*0 and 8*b*0, the dummy ring 10 being adjacent to the turbine rotor 7 so as to suppress the leaking of the steam to those parts.

In the preferred embodiment, the cooling steam supply path 101 is formed in the dummy ring 10 in the radial direction between the pair of the HP inlet parts. The discharge steam $s_1$ of the VHP turbine 1 is introduced as cooling steam to the cooling steam supply path 101. The cooling steam supply path 101 reaches the outer circumferential surface 72 of the turbine rotor 7 and is in communication with the clearances 720*a* and 720*b* disposed symmetrically between the turbine rotor 7 and the dummy ring 10. The discharge steam $s_1$ introduced to the cooling steam supply path 101 streams in the clearances 720*a* and 720*b* toward the HP turbine blade cascade parts 71*a*0 and 71*b*0 on both sides.

Cooling holes 71*a*2 and 71*b*2 for streaming the cooling steam $s_1$ are formed in a bottom part or the like of blade grooves of the HP turbine blade cascade parts 71*a*0 and 71*b*0 and the first-stage rotor blades 71*a*1 and 71*b*1. In the preferred embodiment, the steam inlet part of the IP turbine 132 has the same structure as the HP turbine 131 of FIG. 5. Thus, the working steam inlet part of the IP turbine 132 is not further explained here.

In the preferred embodiment, the discharge steam $s_1$ of the VHP turbine 1 to be introduced to the cooling steam supply path 101 has a temperature (e.g. 500° C.) sufficiently lower than that of the HP steam at the inlet of the HP turbine 131 as well as being lower than that of the HP steam streaming into the clearances 720*a* and 720*b* through the first-stage stator blades 8*a*1 and 8*b*1. The pressure of the discharge steam $s_1$ is set higher than that of diverted steam streaming into the clearances 720*a* and 720*b* through the first-stage stator blades 8*a*1 and 8*b*1.

As shown in FIG. 5, the pressure of the discharge steam $s_1$ of the VHP turbine 1, the pressure of the HP exit steam from the first-stage stator blade 8*a*1 and 8*b*1 (the diverted steam) are respectively described as $P_1$ and $P_0$. And each of the pressures satisfies the relationship shown as a formula (2) below.

$$P_1 \geq P_0 \tag{2}$$

Therefore, the discharge steam $s_1$ can be spread all over the clearances 720*a* and 720*b* against the diverted steam. By this, it is possible to cool the dummy ring 10 and the turbine rotor inside of the dummy ring more effectively than the conventional cooling method.

It is because the discharge steam $s_1$ of the VHP turbine 1 is the steam having worked in the VHP turbine 1 and the temperature is much lower than the steam temperature of the first-stage stator blade of the HP turbine parts 31*a*0 and 31*b*0 which was used as the cooling steam in the conventional cooling method.

The discharge steam $s_1$ streams into the blade cascade parts 71*a*0 and 71*b*0 through the cooling holes 71*a*2 and 71*b*2 provided in the HP blade cascade parts 71*a*0 and 71*b*0 and thus, it is possible to cool the HP blade cascade parts 71*a*0 and 71*b*0 as well.

In the preferred embodiment, the IP steam inlet part of the IP turbine 132 has the same structure as the HP steam inlet part of the HP turbine 131. The discharge steam of the HP turbine 131 (e.g. 500° C.) having a temperature much lower than that of the IP steam at the inlet of the IP turbine 132 is supplied as cooling steam to the IP steam inlet part of the IP turbine 132 via the steam communication pipe 110. Thus, it is possible to cool the vicinity of the working steam inlet part of the IP turbine 132 more effectively than the conventional cooling method.

The discharge steam of the HP turbine 131 is the steam having worked in the HP turbine parts 31*a*0 and 31*b*0 and the temperature is much lower than the steam temperature of the first-stage stator blade (unshown) of the IP turbine parts 32*a*0 and 32*b*0 which was used as the cooling steam in the conventional cooling method. Thus, the cooling effect can be improved.

The cooling steam that is adequate for the pressure and temperature conditions of each of the HP turbine 131 and the IP turbine 132 is used in the preferred embodiment. Thus, it is possible to effectively cool the inlet part of the high-temperature steam of each of the HP turbine 131 and the IP turbine 132 respectively.

This gives the HP turbine blade cascade parts 71*a*0 and 71*b*0 and the IP turbine blade cascade parts (unshown) more freedom in terms of selection of materials, a strong design and a material design, resulting in facilitating an actual turbine design.

By cooling the working steam inlet part of the HP turbine 131 and the IP turbine 132, it is possible to provide strength in a welding part whose strength is expected to be lower than that of a base material in the case of adopting a welding structure in a rotating part or a stationary part in the inlet part or its surrounding. This provides more freedom in the strength design of the welding part. On this point as well, it is advantageous for the actual turbine design.

In the preferred embodiment, the structure of cooling each of the HP turbine 131 and the IP turbine 132 is explained. However it is also possible to cool one of the HP turbine 131 and the IP turbine 132 as needed.

Third Preferred Embodiment

Figure 6:
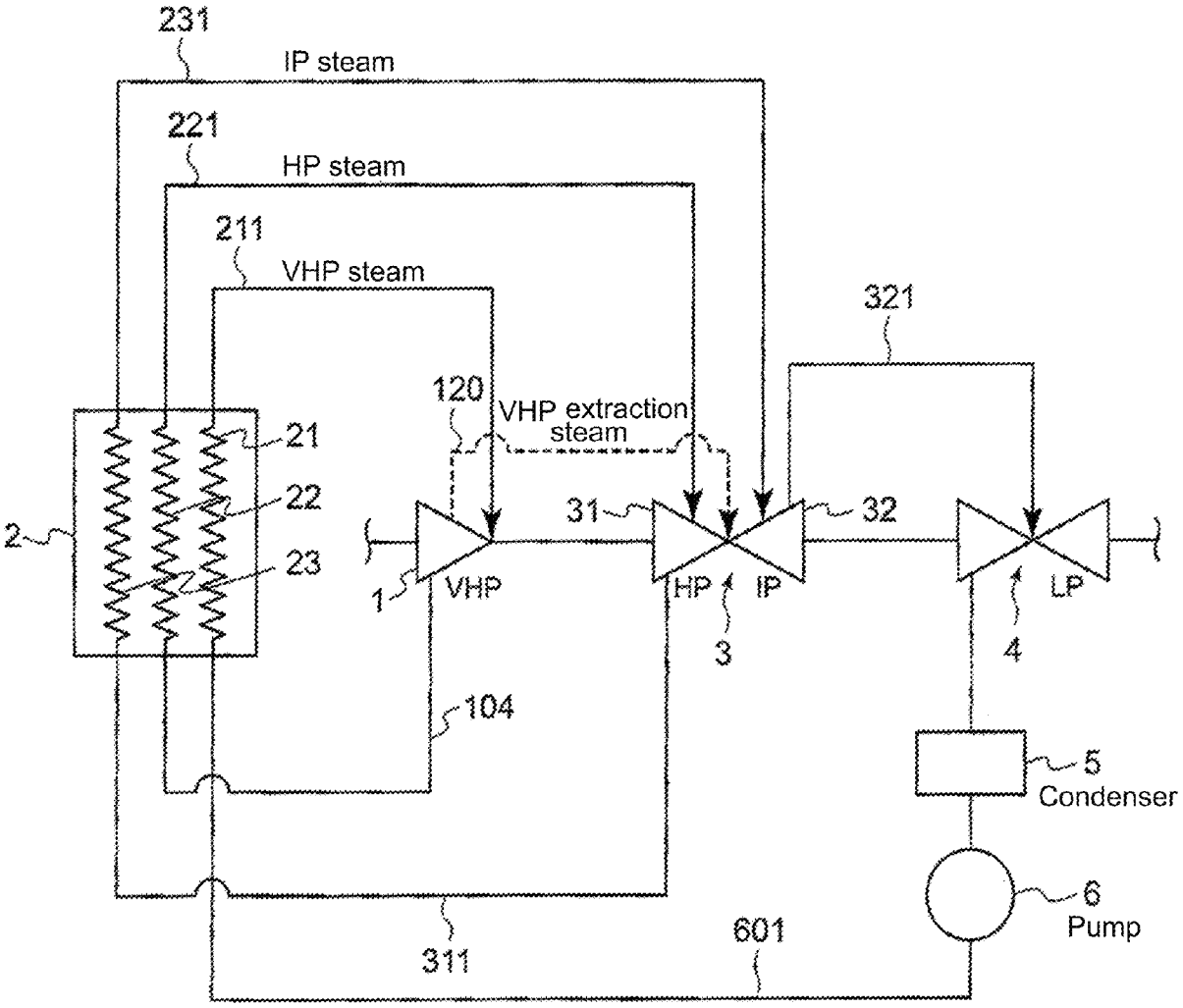
FIG. 6 is a systematic diagram showing a third preferred embodiment of a steam turbine power plant to which the present invention is applicable.

A third preferred embodiment in which the present invention is applied to a steam turbine power plant is explained in reference to FIG. 6. Instead of the discharge steam of the VHP turbine 1 in the first preferred embodiment, extraction steam extracted from an intermediate stage of the VHP turbine is supplied to the HIP turbine 3 and used as cooling steam in the third preferred embodiment as shown in FIG. 6. Specifically, the steam communication pipe 120 connects the blade cascade part of the intermediate stage of the VHP turbine 1 and the cooling steam supply path 101 of the HIP turbine. The steam communication path supplies the extraction steam of the blade cascade part of the intermediate stage of the VHP turbine 1 to the cooling steam supply path 101 of the HIP turbine 3.

The rest of the structure is similar to the first preferred embodiment and thus, the structure same as the first preferred embodiment is not explained further. If the pressure of the extraction steam is $P_1$, the pressure $P_1$ of the extraction steam satisfies the above formula (1).

The extraction steam supplied as cooling steam from the VHP turbine 1 to the HIP turbine 3 has a temperature lower than that of the steam diverted through the first-stage stator blade 8*a*1 of the HP turbine part 31 or the first-stage stator blade 9*a*1 of the IP turbine part 32 and has a pressure not less than that of the diverted steam. Thus, the extraction steam can be spread throughout the clearances 720 and 721 between the dummy ring 10 and the HP dummy part 72 of the turbine rotor 7, thereby improving the cooling effect of the dummy ring 10 and the HP dummy part 72.

By arbitrarily selecting where in the blade cascade of the VHP turbine 1 to extract the steam, the cooling steam having optimum pressure and temperature for cooling the working steam inlet part of the HIP turbine 3 and thus, it is possible to cool the working steam inlet part of the HIP turbine 3 to an optimum temperature.

Fourth Preferred Embodiment

Figure 7:
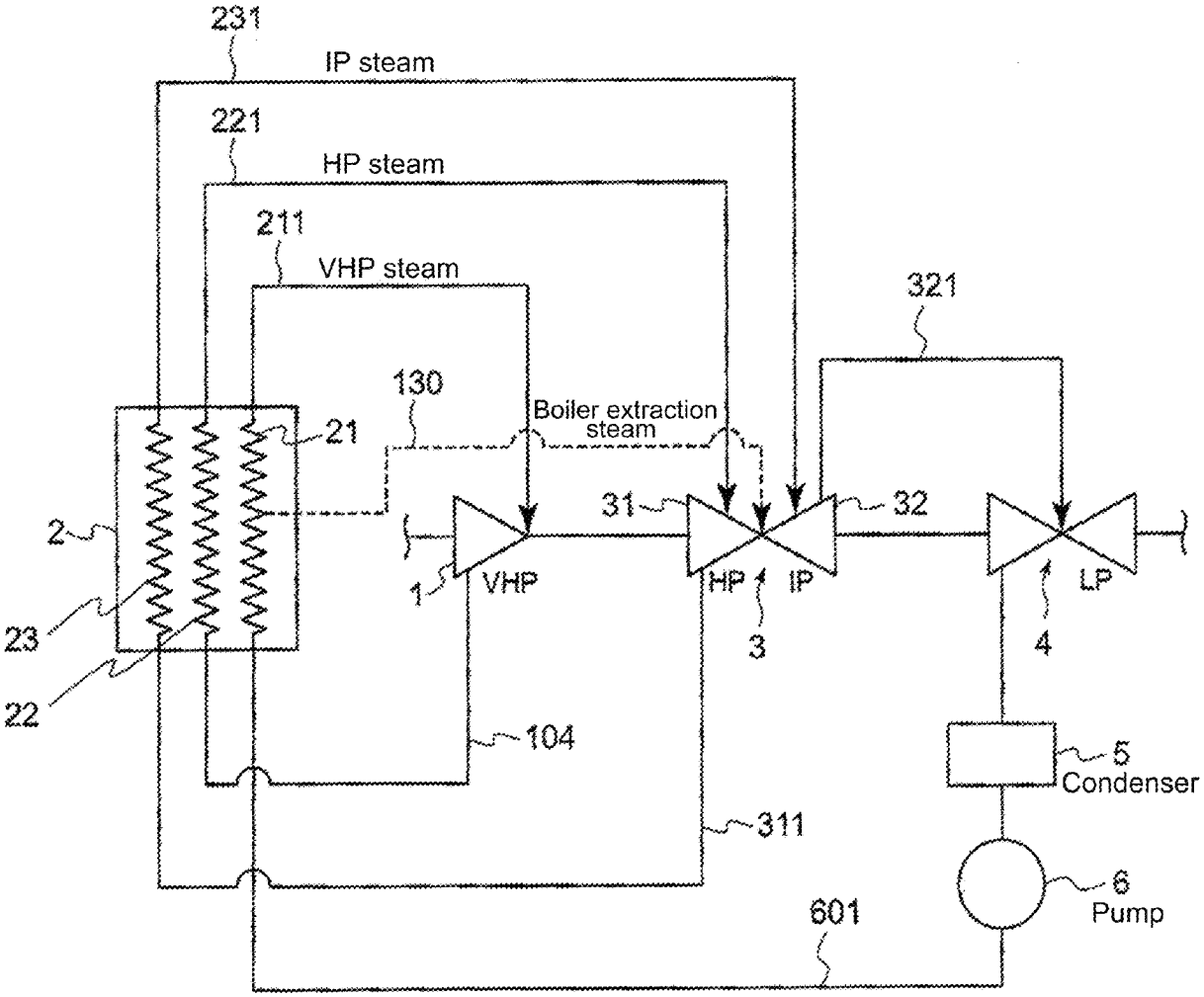
FIG. 7 is a systematic diagram showing a fourth preferred embodiment of a steam turbine power plant to which the present invention is applicable.

FIG. 7 shows a fourth preferred embodiment in which the present invention is applied to a steam turbine power plant. In the first preferred embodiment, part of the discharge steam of the VHP turbine 1 is used as cooling steam for the HIP turbine 3. In contrast, in the third preferred embodiment, part of the steam in the process of being heated to produce VHP steam is extracted from the superheater 21 of the boiler and supplied as cooling steam to the working steam inlet part of the HIP turbine via the steam communication pipe. The rest of the structure is the same as the first preferred embodiment and thus, is not explained further.

In the preferred embodiment, in the process of superheating final water supplied to the boiler 2 from the pump 6 to produce VHP steam, boiler extraction steam branched from midway of the superheater 21 is supplied to the HIP turbine 3 as cooling steam. The boiler extraction steam has sufficient superheated temperature in the superheater 21 and a temperature (e.g. 600° C.) much lower than the temperature at the inlet of the HP turbine part 31 and the IP turbine part 32 of the HIP turbine. Specifically, the extraction steam is the steam extracted from the area where the temperature is not completely raised. The extraction steam is supplied to the HIP turbine 3. Assuming that the pressure of the boiler extraction steam is $P_1$, the pressure $P_1$ of the extraction steam satisfies the formula (1).

In the preferred embodiment, the boiler extraction steam from the superheater has a temperature much lower than the temperature of the working steam at the inlet of the HP turbine part 31. The boiler extraction steam is used as cooling gas to cool the inlet part of the high-temperature steam of the HP turbine part 31 or the IP turbine part 32 of the HIP turbine 3. Hus, it is possible to improve the cooling effect in the vicinity of the inlet part of the high-temperature steam of the HIP turbine in comparison to the conventional case. That is because the extraction steam from the superheater 21 is the steam before being completely heated to a setting temperature in the boiler 2 and has a temperature much lower than that of the steam at the exit of the first-stage stator blade 8*a*1 of the HP turbine part 31, which is used as cooling steam in the conventional cooing method.

Instead of using the extraction steam from the superheater 21 as cooling steam in the modified example of the preferred embodiment, extraction steam of the first-stage reheater 22 or the second-stage reheater 23 of the boiler 2 may be used as cooling steam.

Fifth Preferred Embodiment

Figure 8:
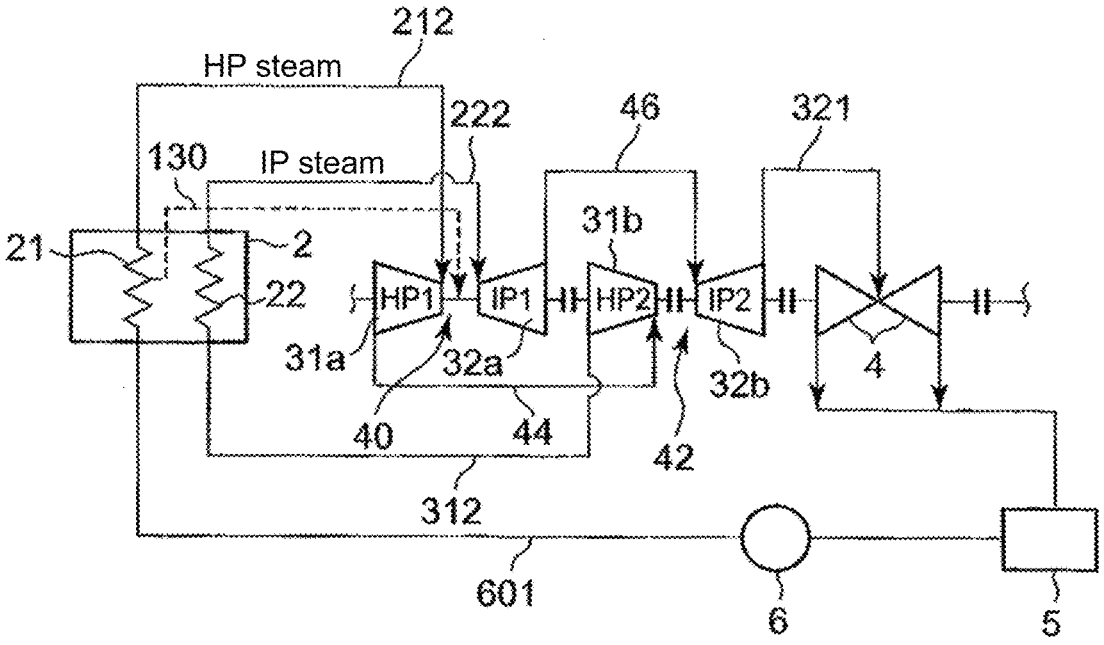
FIG. 8 is a systematic diagram showing a fifth preferred embodiment of a steam turbine power plant to which the present invention is applicable.

FIG. 8 shows a fifth preferred embodiment in which the present invention is applied to a steam turbine power plant. FIG. 8 shows the boiler 2 having the superheater 21 and the repeater 22, a HP turbine divided into two, an IP turbine divided into two and one LP turbine 4 (HP1-IP1-HP2-IP2-LP).

The HP turbine is divided into a first HP turbine part (HP1 turbine part) 31*a* on a high temperature and pressure side and a second HP turbine part (HP2 turbine part) 31*b* on a low temperature and pressure side. The IP turbine is divided into a first IP turbine part (IP1 turbine part) 32*a* on a high temperature and pressure side and a second IP turbine part (IP2 turbine part) 32*b* on a low temperature and pressure side. The HP1 turbine part 31*a* and the IP1 turbine part 32*a* are installed securely to the turbine rotor and housed in a single casing to constitute a steam turbine 40 of high and intermediate pressure opposed-flow single-casing type (hereinafter referred to as HIP1 turbine 40).

The HP2 turbine part 31*b* and the IP2 turbine part 32*b* are installed securely to the turbine rotor and housed in a single casing to constitute a steam turbine 42 of high and intermediate pressure opposed-flow single-casing type (hereinafter referred to as H2P2 turbine 42). The HIP1 turbine 40, the H2P2 turbine 42 and the LP turbine 4 are coaxially connected to the turbine rotor.

In the preferred embodiment, the HP steam (e.g. 650° C.) generated in the superheater 21 of the boiler 2 is introduced to the HP1 turbine part 31*a* via a steam pipe 212 so as to drive the HP1 turbine part 31*a*. The discharge steam (less than 650° C.) of the HP1 turbine part 31*a* is introduced to the HP2 turbine part 31*b* via the HP communication pipe 44 so as to drive the HP2 turbine part 31*b*. The discharge steam of the HP2 turbine part 31*b* is introduced to the reheater 22 via a discharge steam pipe 312 and reheated in the reheater 22 to generate the IP steam (e.g. 650° C.). The IP steam is then introduced to the IP1 turbine part 32*a* via a steam pipe 222 so as to drive the IP1 turbine part 32*a*.

The discharge steam (less than 650° C.) of the IP1 turbine part 32*a* is introduced to the IP2 turbine part 32*b* via an IP communication pipe 46 so as to drive the IP2 turbine part 32*b*. Next, the discharge steam of the IP2 turbine part 32*b* is introduced to the LP turbine 4 via the crossover pipe 321 so as to drive the LP turbine 4. The discharge steam of the LP turbine 4 is condensed by the condenser 5, pressurized by the boiler supply pump 6 and then circulated back to the HIP1 turbine 40 as the HP steam.

In the process of heating final water supplied to the from the pump 6 to produce the HP steam in the boiler 2, boiler extraction steam branched from midway of the superheater 21 is supplied to the working steam inlet part of the HIP1 turbine 40 as cooling steam. The boiler extraction steam has sufficient superheated temperature in the superheater 21 and a temperature (e.g. 600° C.) much lower than the temperature at the inlet of the HP1 turbine part 31*a* and the IP1 turbine part 32*a*. Specifically, the extraction steam is the steam extracted from the area where the temperature is not completely raised. The extraction steam is supplied to the HIP1 turbine 40. The temperature and pressure conditions of the extraction steam are the same as those of the fourth preferred embodiment.

The structure near the working steam inlet part of the HIP1 turbine is the same as that of the first preferred embodiment shown in FIG. 2 and thus is not explained further.

In the fifth preferred embodiment, the boiler extraction steam from the superheater 21 has a temperature much lower than the temperature of the working steam at the inlet part of the HP1 turbine part 31*a* and the IP1 turbine part 32*a*. The boiler extraction steam is used as cooling gas to cool the inlet part of the high-temperature steam of the HP1 turbine part 31*a* and the IP1 turbine part 32*a*. Thus, it is possible to improve the cooling effect in the vicinity of the inlet in comparison to the conventional case. That is because the extraction steam from the superheater 21 is the steam before being completely heated by the boiler 2 to a setting temperature and has a temperature much lower than that of the steam at the exit of the first-stage stator blade of the HP1 turbine part 31*a*, which is used as cooling steam in the conventional cooing method.

Sixth Preferred Embodiment

Figure 9:
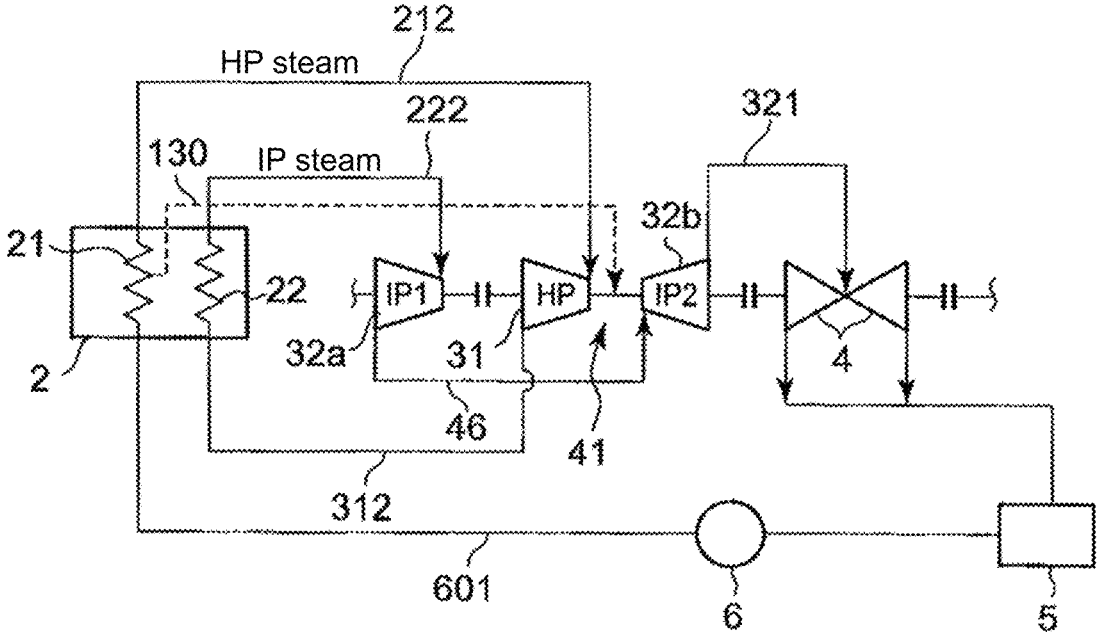
FIG. 9 is a systematic diagram showing a sixth preferred embodiment of a steam turbine power plant to which the present invention is applicable.

FIG. 9 shows a sixth preferred embodiment in which the present invention is applied to a steam turbine power plant. In the fifth preferred embodiment, the HP turbine 31 is divided into plural turbine parts. In contrast, in the sixth preferred embodiment, the IP turbine is divided into the IP1 turbine on the high temperature and pressure side and the IP2 turbine 32*b* on the low temperature and pressure side. Further, the HP turbine 31 and the IP2 turbine part 32*b* are installed securely to the turbine rotor and housed in a single casing to constitute a steam turbine 41 (HIP turbine) of a high and intermediate pressure opposed-flow single-casing type (IP1-HP-IP2-LP). The IP1 turbine 32*a*, the HIP turbine 41 and the LP turbine 4 are coaxially connected to the single turbine rotor.

In the sixth preferred embodiment, the HP steam (e.g. 650° C.) generated in the superheater 21 of the boiler 2 is introduced to the HP turbine part 31 of the HIP turbine 41 to drive the HP turbine part 31. The discharge steam of the HP turbine part 31 passes through the repeater 22 of the boiler to generate the IP steam (e.g. 650° C.). The IP steam is then introduced to the IP1 turbine 32*a* to drive the IP1 turbine 32*a*. The discharge steam of the IP1 turbine 32*a* (below 600° C.) is introduced to the IP2 turbine part 32*b* via the IP communication pipe 46 to drive the Ip2 turbine part 32*b*.

Then, the discharge steam of the IP2 turbine part 32*b* is introduced to the LP turbine 4 through the crossover pipe 321 to drive the LP turbine 4. The discharge steam of the LP turbine 4 is condensed in the condenser 5, pressurized by the boiler supply pump 6 and then returned to the boiler 2 to generate the HP steam again. The HP steam is then circulated to the HP turbine part 31. Further, in the process of superheating final water supplied to the boiler 2 from the pump 6 to produce the HP steam in the boiler 2, boiler extraction steam branched from midway of the superheater 21 is supplied to the working steam inlet part of the HIP turbine 41 as cooling steam.

The boiler extraction steam has sufficient superheated temperature in the superheater 21 and a temperature (e.g. 600° C.) lower than the steam temperature at the inlet of the HP turbine part 31 and the IP turbine 32*b*. Specifically, the extraction steam is the steam extracted from the area where the temperature is not completely raised. The extraction steam is supplied to the HIP turbine 41. The temperature and pressure conditions of the boiler extraction steam are the same as those of the fifth preferred embodiment.

The structure of the working steam inlet part of the HIP turbine 41 is the same as that of the HIP turbine 3 in the first preferred embodiment shown in FIG. 2 except that the boiler extraction steam is supplied as the cooling steam instead of the VHP discharge steam. Thus, the working steam inlet part is not further explained in detail here.

In the sixth preferred embodiment, the boiler extraction steam extracted from the superheater 21 of the boiler 2 has a temperature much lower than the temperature of the working steam at the inlet part of the HP turbine part 31 and the IP2 turbine part 32*b* and the boiler extraction steam is used as the cooling steam to cool the working steam inlet part of the HIP turbine 41. Thus, it is possible to improve the cooling effect of the working steam inlet part of the HIP turbine 41 in comparison to the conventional case.

Seventh Preferred Embodiment

Figure 10:
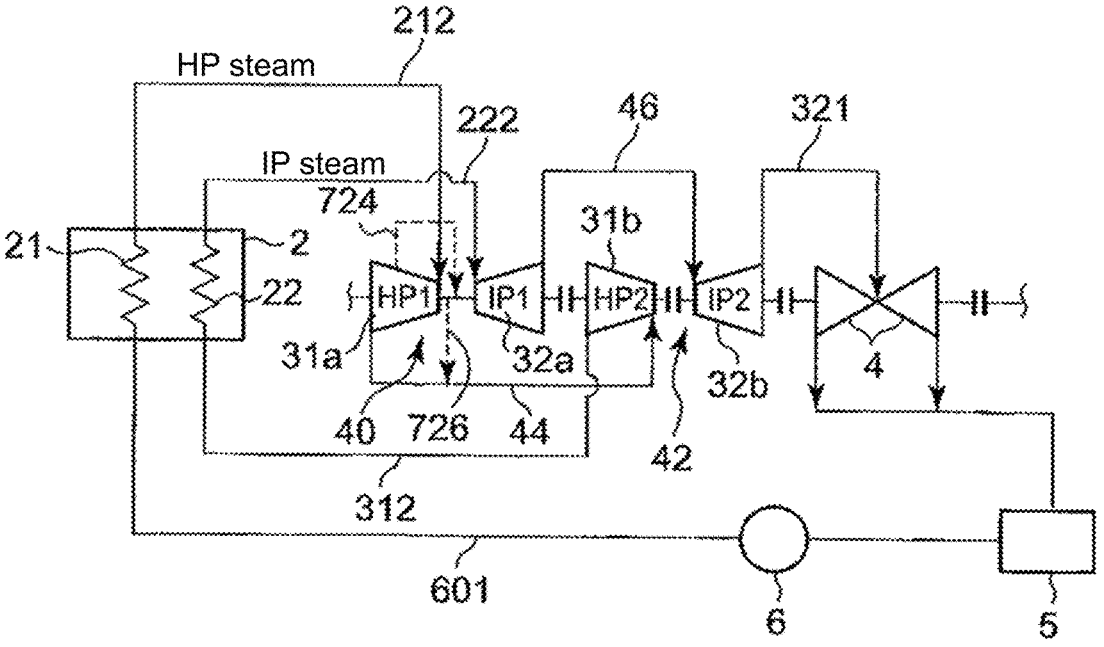
FIG. 10 is a systematic diagram showing a seventh preferred embodiment of a steam turbine power plant to which the present invention is applicable.

FIG. 10 shows a seventh preferred embodiment in which the present invention is applied to a steam turbine power plant. Instead of using the extraction steam from the superheater 21 as cooling steam to the HIP turbine 40 as in the case of the fifth preferred embodiment, in the seventh preferred the extraction steam extracted from between the blade cascades of the HP1 turbine part 31*a* is used as cooling steam. The rest of the structure is similar to that of the fifth preferred embodiment and thus not explained further.

In FIG. 10, the extraction steam of the HP1 turbine part 31*a* is supplied to the working steam inlet part of the HIP1 turbine 40 via a steam communication pipe 724.

Figure 11:
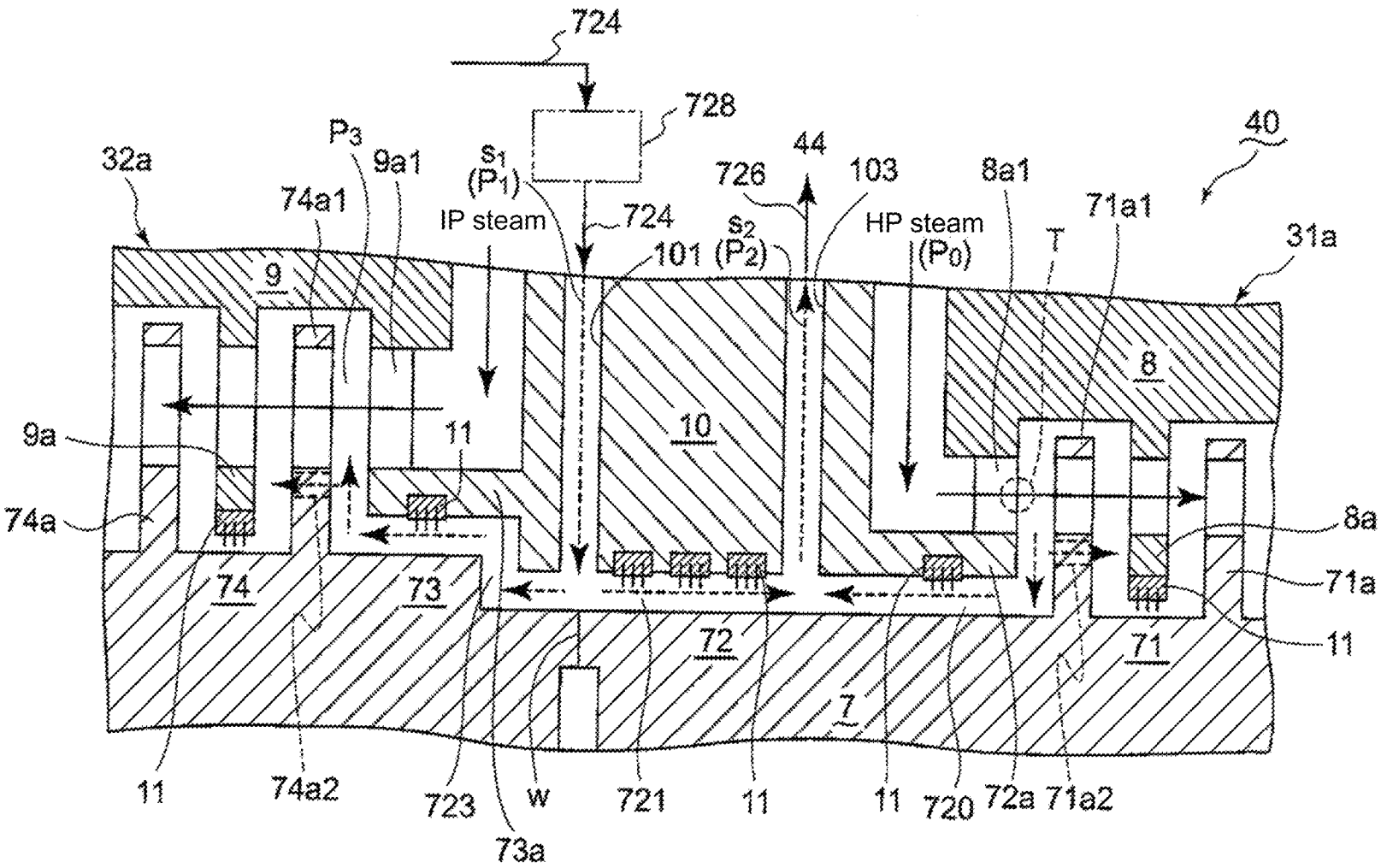
FIG. 11 is a sectional view of a structure of a working steam inlet part of a HIP1 turbine 40 of FIG. 10.
Figure 12:
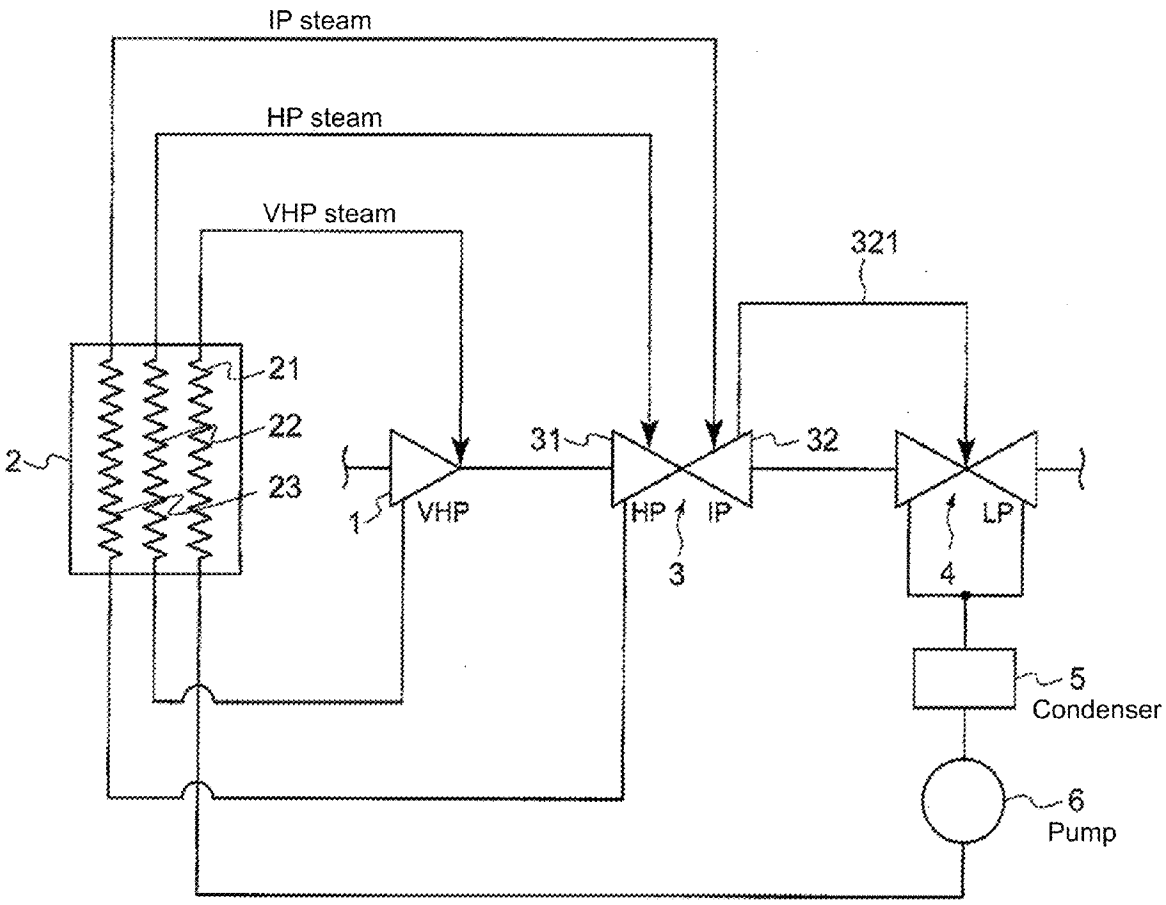
FIG. 12 is a systematic diagram showing a steam turbine power plant of related art.
Figure 13:
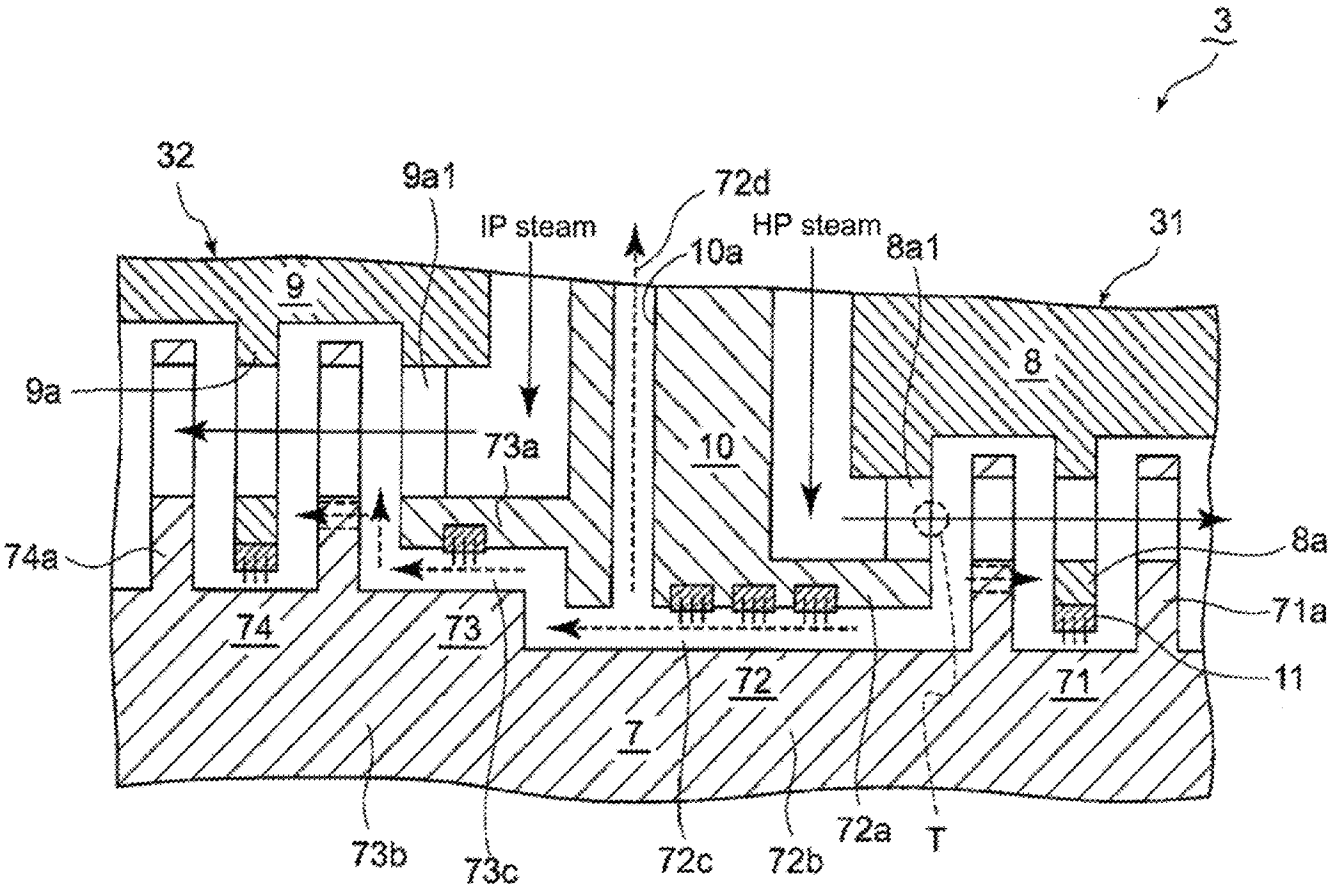
FIG. 13 is a sectional view of a structure of a steam inlet part of a HIP turbine 3 of FIG. 12.

FIG. 11 shows the structure of the working steam inlet part of the HIP1 turbine 40. The structure is generally same as the working steam inlet part of the first preferred embodiment shown in FIG. 2 except that the cooling steam is supplied to the steam inlet part and then discharged through the discharge path that is different from the first preferred embodiment. The rest of the structure that is the same as the first preferred embodiment is not explained here.

In the seventh preferred embodiment, the cooling steam supply path 101 is formed in the dummy ring 10 in the radial direction on the side nearer to the IP1 turbine part 32*a*. The cooling steam supply path 101 opens to the clearance 721 and 723 formed between the dummy ring 10 and the HP dummy part 72 and the IP dummy part 73 of the turbine rotor 7. The blade cascade of the HP1 turbine part 31*a* of the HIP1 turbine 40 and the cooling steam supply path 101 are connected by the steam communication pipe 724. The extraction steam $s_1$ extracted from between the blade cascades is introduced as cooling steam to the cooling steam supply path 101 via the steam communication pipe 724.

The cooling steam discharge path 103 is formed in the dummy ring in the radial direction on the side nearer to the HP1 turbine part 31*a* than the cooling steam supply path 101 is. The cooling steam discharge path 103 opens to the clearance 720 and 721 formed between the dummy ring and the HP dummy part of the turbine rotor 7. The cooling steam discharge path 103 is connected to the discharge steam pipe and supplies the discharge steam of the HP1 turbine part 31*a* to the HP2 turbine part 31*b* of the HIP2 turbine 42 as the working steam via the discharge steam pipe 44.

Part of the HP exit steam from the exit T of the first-stage stator blade 8*a*1 of the HP1 turbine part 31*a*, streams to the opposite side of the axial direction from the HP turbine blade cascade part 71 into the clearance 720 between the HP dummy ring 72*a* and the turbine rotor 7. Meanwhile, the extraction steam $s_1$ extracted from between the blade cascades of the HP1 turbine part 31*a* streams into the clearance 721 on the inner side of the dummy ring 10 via the cooling steam supply path 101. Then, some of the extraction steam $s_1$ streams through the clearance 723 to the IP turbine blade cascade part 74 while the rest of the extraction steam $s_1$ streams through the clearance 721 to the opposite direction, i.e. to the HP1 turbine part 31*a* side.

The extraction steam $s_1$ branched toward the HP1 turbine part 31*a* and the steam that branches from the exit T of the first-stage stator blade 8*a*1 and passes through the clearance 720, are joined and discharged through the cooling steam discharge path 103. The discharge steam $s_2$ passes through the cooling steam discharge path 103 and is then supplied as working steam to the HP2 turbine part 31*b* through the discharge steam pipe 44. The discharge steam $s_2$ that passes through the cooling steam discharge path 103 can balance a thrust force loaded on the turbine rotor 7.

All of the steam that branches from the exit T of the first-stage stator blade 8*a*1 of the HP1 turbine part 31*a*, passes through the clearance 720 and led to the discharge steam pipe 44 through the cooling steam discharge path 103 without streaming to the IP1 turbine blade cascade part 74. The extraction steam $s_1$ of the HP1 turbine part 31*a* may be extracted from between the blade cascades where the pressure is equal to or higher than that of the discharge steam of the HP1 turbine part 32*a*.

As shown in FIG. 11, the pressure of the working steam that is supplied to the inlet part of the HP1 turbine part 31*a*, the pressure of the HP extraction steam $s_1$, the pressure of the discharge steam $s_2$ that is the working steam having reached the cooling steam discharge path 103 through the first-stage stator blade 8*a*1, the steam pressure at the exit of the first-stage stator blade of the IP1 turbine part 32*a* are respectively described as $P_0$, $P_1$, $P_2$ and $P_3$. And each of the pressures satisfies the relationship shown as a formula (3) below.

$$P_0>P_1\geq P_2>P_3 \quad (3)$$

If the pressure $P_1$ of the extraction steam $s_1$ is higher than the pressure $P_2$ of the discharge steam $s_2$ or the pressure $P_3$ at the exit of the IP first-stage stator blade, the extraction steam s1 can be spread in the clearances 721 and 723 against the exit steam of the HP steam and the IP steam from the first-stage stator blades 8*a*1 and 9*a*1 respectively. The extraction steam s1 is the steam partially having worked in the HP1 turbine 32*a* and has a temperature much lower than that of the exit steam from the first-stage stator blade of the HP1 turbine part 31*a* to be used as cooling steam as in the case of the conventional cooling method. Thus, it is possible to improve the cooling effect of the dummy ring 10 and the outer circumferential surface 72 of the turbine rotor 7 arranged on the inner side of the dummy ring 10.

According to the preferred embodiment, the temperature of the extraction steam s1 of the HP1 turbine part 31*a* is much lower than that of the working steam at the inlet part of the HP1 turbine part 31*a* and the inlet part of the IP1 turbine part 32*a* and the extractions team s1 can be introduced via the cooling steam supply path 101 throughout the clearances 721 and 723 between the outer circumferential surface 72 of the rotor 7 and the dummy ring 10. Thus, it is possible to reduce the temperature of the working steam inlet part of the HIP1 turbine 40 that is subjected to high temperature in comparison to the conventional cooling method.

Particularly in the case of adopting a welding structure in a rotating part or a stationary part in and around the working steam inlet part, it is possible to provide strength in a welding part whose strength is expected to be lower than that of a base material. From this perspective, the designing of an actual turbine is made easier.

Specifically, a plurality of split members of different materials are joined together by welding or the like to constitute the turbine rotor 7. In the case wherein the welding part w is on the inner side of the dummy ring 10, the welding part w is subjected to high-temperature atmosphere, which can reduce the strength of the welding part w.

To take measures against this, the cooling steam s1 is introduced to the clearances 721 and 723 from the cooling steam supply path 101 so as to improve the cooling effect of the welding part w. This can prevent the strength decrease of the welding part w.

In the preferred embodiment, the extraction steam s1 of the HP1 turbine part 31*a* is used as cooling steam. Alternatively, the discharge steam of the HP1 turbine part 31*a* may be used as cooling steam.

As a modified example of the seventh preferred embodiment, the extraction steam s1 of the HP1 turbine part 31*a* may be introduced to a cooler 728 as shown in FIG. 11 and precooled before being supplied to the cooing steam supply path 101. For instance, the extraction steam s1 passes through a heat-transfer tube constituted of finned tubes, spiral tubes with increased heat-transfer area or the like. Further, a fan is used in combination, to send cold air to the heat-transfer tube, thereby air-cooling the extractions team s1.

Alternatively, if the heat-transfer tube has a double tube structure, the extraction steam s1 is fed to one path and cooling water is fed to the other path so as to water-cool the extraction steam s1. The heat recovered in the process may be utilized for other devices. This can firmly reduce the temperature of the working steam inlet part of the HIP1 turbine 40 to a lower temperature.

While the present invention has been described with reference to the preferred embodiments, it is obvious to those skilled in the art that various changes may be made without departing from the scope of the invention.

According to the present invention, it is possible in the steam turbine generator facility to efficiently cool the vicinity of the working steam inlet part of the steam turbine of the opposed-flow single-casing type which houses in a single casing a plurality of steam turbines of different working steam pressures. Further, the present invention is applicable to all reheat turbines having a structure such as VHP-HIP-LP and VHP-HP-IP-LP.

The invention claimed is:

1. A cooling method for a steam turbine generating facility comprising an opposed-flow single casing steam turbine which is arranged on a higher pressure side of a low pressure turbine and in which a plurality of turbine parts are housed in a single casing and a dummy seal isolates the plurality of turbine parts from one another, the steam turbine generating facility cooling the dummy seal and a rotor shaft arranged on an inner side of the dummy seal, the method comprising:

supplying cooling steam generated in the steam turbine generating facility to a cooling steam supply path formed in the dummy seal, the cooling steam having a temperature lower than a temperature of working steam which has been supplied to each of the plurality of turbine parts of the opposed-flow single casing steam turbine and has passed through a first-stage stator blade, the cooling steam having a pressure which is not less than a pressure of the working steam which has passed through the first-stage stator blade, and cooling the dummy seal and the rotor shaft by introducing the cooling steam to a plurality of clearances formed between the dummy seal and the rotor shaft via the cooling steam supply path and streaming the cooling steam in the clearances against the steam from an exit of the first-stage stator blade, wherein:

the opposed-flow single casing steam turbine includes a first turbine part and a second turbine part which are provided symmetrically in the single casing and are driven by the same working steam;

the cooling steam supply path is arranged between a steam inlet part of the first turbine part and a steam inlet part of the second turbine part;

in said cooling the dummy seal and the rotor shaft, the cooling steam supplied via the cooling steam supply path is configured to branch off, the cooling steam branched off being configured to stream into each of a pair of the clearances arranged symmetrically;

the steam turbine generating facility comprises a very-high-pressure turbine, a high pressure turbine which is driven by high pressure steam obtained by reheating discharge steam of the very-high-pressure turbine, an intermediate pressure turbine which is driven by intermediate pressure steam obtained by reheating discharge steam of the high pressure turbine, and the low pressure turbine which is driven by discharge steam of the intermediate pressure turbine;

the high pressure turbine is formed as the opposed-flow single casing steam turbine and includes a first high pressure turbine part and a second high pressure turbine part which are provided symmetrically in the single casing;

the cooling steam supply path of the high pressure turbine is arranged between a steam inlet part of the first high pressure turbine part and a steam inlet part of the second high pressure turbine part;

in said supplying the cooling steam, the discharge steam of the very-high-pressure turbine is configured to be supplied to the cooling steam supply path of the high pressure turbine as the cooling steam; and in said cooling the dummy seal and the rotor shaft, the discharge steam of the very-high-pressure turbine supplied via the cooling steam supply path as the cooling steam is configured to branch off, the discharge steam of the very-high-pressure turbine branched off being configured to stream into each of the pair of the clearances of the high pressure turbine.

2. The cooling method according to claim 1, wherein the rotor shaft is formed by joining split members which are made of different materials, and wherein a joint section at which the split members are joined to form the rotor shaft is formed facing the clearances, the joint section being cooled by the cooling steam.

3. The cooling method according to claim 1, wherein:

the intermediate pressure turbine is formed as the opposed-flow single casing steam turbine and includes a first intermediate pressure turbine part and a second intermediate pressure turbine part which are provided symmetrically in the single casing;

the cooling steam supply path of the intermediate pressure turbine is arranged between a steam inlet part of the first intermediate pressure turbine part and a steam inlet part of the second intermediate pressure turbine part;

in said supplying the cooling steam, the discharge steam of the high pressure turbine is configured to be supplied to the cooling steam supply path of the intermediate pressure turbine as the cooling steam; and in said cooling the dummy seal and the rotor shaft, the discharge steam of the high pressure turbine supplied via the cooling steam supply path as the cooling steam is configured to branch off, the discharge steam of the high pressure turbine branched off being configured to stream into each of the pair of the clearances of the intermediate pressure turbine.

4. A cooling device for a steam turbine generating facility comprising an opposed-flow single casing steam turbine which is arranged on a higher pressure side of a low pressure turbine and in which a plurality of turbine parts are housed in a single casing and a dummy seal isolates the plurality of turbine parts from one another, the steam turbine generating facility cooling the dummy seal and a rotor shaft arranged on an inner side of the dummy seal, the device comprising:

a cooling steam supply path formed in the dummy seal and configured to open to a plurality of clearances between the dummy seal and the rotor shaft; and a cooling steam pipe connected to the cooling steam supply path so as to supply cooling steam generated in the steam turbine generating facility to the cooling steam supply path at a temperature lower than that of working steam which has been supplied to each of the plurality of turbine parts of the opposed-flow single casing steam turbine and has passed through a first-stage stator blade and at a pressure not less than the pressure of the working steam at an exit of the first-stage stator blade, wherein:

the cooling steam is configured to stream into the clearances between the dummy seal and the rotor shaft via the cooling steam supply path to cool the dummy seal and the rotor shaft;

the opposed-flow single casing steam turbine includes a first turbine part and a second turbine part which are provided symmetrically in the single casing and are driven by the same working steam;

the cooling steam supply path is arranged between a steam inlet part of the first turbine part and a steam inlet part of the second turbine part;

the cooling steam supplied via the cooling steam supply path branches off, the cooling steam branched off streaming into each of a pair of the clearances arranged symmetrically;

the steam turbine generating facility comprises a very-high-pressure turbine, a high pressure turbine which is driven by high pressure steam obtained by reheating discharge steam of the very-high-pressure turbine, an intermediate pressure turbine which is driven by intermediate pressure steam obtained by reheating discharge steam of the high pressure turbine, and the low pressure turbine which is driven by discharge steam of the intermediate pressure turbine;

the high pressure turbine is formed as the opposed-flow single casing steam turbine and includes a first high pressure turbine part and a second high pressure turbine part which are provided symmetrically in the single casing;

the cooling steam supply path of the high pressure turbine is arranged between a steam inlet part of the first high pressure turbine part and a steam inlet part of the second high pressure turbine part;

the discharge steam of the very-high-pressure turbine is configured to be supplied to the cooling steam supply path of the high pressure turbine as the cooling steam; and the discharge steam of the very-high-pressure turbine supplied via the cooling steam supply path as the cooling steam is configured to branch off, the discharge steam of the very-high-pressure turbine branched off being configured to stream into each of the pair of the clearances of the high pressure turbine.

5. The cooling device according to claim 4, wherein:

the intermediate pressure turbine is formed as the opposed-flow single casing steam turbine and includes a first intermediate pressure turbine part and a second intermediate pressure turbine part which are provided symmetrically in the single casing;

the cooling steam supply path of the intermediate pressure turbine is arranged between a steam inlet part of the first intermediate pressure turbine part and a steam inlet part of the second intermediate pressure turbine part;

the discharge steam of the high pressure turbine is configured to be supplied to the cooling steam supply path of the intermediate pressure turbine as the cooling steam; and the discharge steam of the high pressure turbine supplied via the cooling steam supply path as the cooling steam is configured to branch off, the discharge steam of the high pressure turbine branched off being configured to stream each of the pair of the clearances of the intermediate pressure turbine.

6. The cooling device according to claim 4, further comprising a superheater disposed in a boiler to superheat steam, wherein steam extracted from the superheater is configured to be supplied to the cooling steam supply path as the cooling steam.

7. The cooling device according to claim 4, further comprising a reheater disposed in a boiler to reheat discharge steam from a steam turbine, wherein reheated steam extracted from the reheater is configured to be supplied to the cooling steam supply path as the cooling steam.

* * * * *